United States Patent [19]

Ogawa et al.

[11] Patent Number: 4,806,460

[45] Date of Patent: Feb. 21, 1989

[54] MULTILAYER SILVER HALIDE COLOR PHOTOGRAPHIC MATERIALS

[75] Inventors: Tadashi Ogawa; Koji Takahashi; Seiichi Taguchi, all of Kanagawa, Japan

[73] Assignee: Fuji Photo Film Co., Ltd., Kanagawa, Japan

[21] Appl. No.: 113,353

[22] Filed: Oct. 26, 1987

Related U.S. Application Data

[63] Continuation of Ser. No. 786,396, Oct. 10, 1985, abandoned.

[30] Foreign Application Priority Data

Oct. 11, 1984 [JP] Japan ..... 59-212915

[51] Int. Cl.[4] ..... G03C 7/18; G03C 7/20

[52] U.S. Cl. ..... 430/504; 430/505; 430/506

[58] Field of Search ..... 430/504–506

[56] References Cited

U.S. PATENT DOCUMENTS

| | | | |
|---|---|---|---|
| 4,273,861 | 6/1981 | Shiba et al. | 430/504 |
| 4,358,532 | 11/1982 | Koyama et al. | 430/559 |
| 4,414,308 | 11/1983 | Hamada | 430/505 |
| 4,477,563 | 10/1984 | Ichijima et al. | 430/544 |
| 4,564,587 | 1/1986 | Watanabe et al. | 430/506 |
| 4,647,527 | 3/1987 | Ikenoue et al. | 430/506 |

*Primary Examiner*—Richard L. Schilling

*Attorney, Agent, or Firm*—Sughrue, Mion, Zinn, Macpeak & Seas

[57] ABSTRACT

A multilayer silver halide color photographic material is described, comprising a support having thereon at least two light-sensitive silver halide emulsion layers, each having a different color sensitivity, and having associated therewith dye-forming agents forming imaging dyes, each having a different hue, wherein at least one dye of a hue substantially not contributing to the formation of the hue of a specific image of a region that the image density of at least one of said imaging dyes is above a definite density value of from 1.2 to 2.5 is provided so as to provide gradation to the specific image region.

29 Claims, 3 Drawing Sheets

MULTILAYER SILVER HALIDE COLOR PHOTOGRAPHIC MATERIALS

This is a continuation of application Ser. No. 786,396, filed Oct. 10, 1985, now abandoned.

FIELD OF THE INVENTION

This invention relates to silver halide color photographic materials providing improved image quality, and, more particularly, to silver halide color photographic materials having improved tone reproduction and color reproduction.

BACKGROUND OF THE INVENTION

In recent times, for photographic materials, high image quality has been strongly demanded not only for small formats such as 110 size cameras and disk cameras, but also for the more conventional 35 mm type format. For increasing the image quality of color photographic light-sensitive materials, it is necessary to improve various photographic characteristics, such as the sharpness, graininess, etc., of the images, as well as color reproduction and tone reproduction.

Color photographic light-sensitive materials forming yellow images, magenta images, and cyan images in the blue-sensitive emulsion layer, the green-sensitive emulsion layer, and the red-sensitive emulsion layer, respectively, are well known. That is, by color-developing the silver halide color photographic material, the couplers in the color-sensitive emulsion layers thereof are reacted with the oxidation product of an aromatic primary amine color developing agent to form color images of azomethine dyes, indoaniline dyes, and the like. In an ordinary color negative photographic film system, the color reproduction based on a subtractive color photographic process is performed, and hence negative dye images, the colors of which are in a complementary color relation with the colors of the photographed object and the shade of which is in contrary with that of the object are formed on a color negative photographic film having the combinations of the color sensitivity and the coloring property described above. Then, by printing the negative film on a color photographic paper having similar layer structures, a color print having the correct reproductions of the colors and shade of the photographed object is obtained.

For color negative photographic films, photographic couplers, in particular, so-called DIR (development inhibitor releasing) couplers capable of releasing a development inhibitor by causing reaction with the oxidation product of a color developing agent are generally used.

A DIR coupler is a coupler having introduced into the coupling active position thereof a group which is released therefrom to show a development inhibiting action or a precursor thereof. Specific examples of such couplers are described, for example, in U.S. Pat. Nos. 3,227,554, 3,701,783, 3,615,506, 3,617,291, etc., and also improved compounds of these couplers are described in U.S. Pat. Nos. 3,933,500 and 4,477,563.

As described in the above literatures, these DIR couplers provide improvements in the sharpness of color images by edge effects as well as in the color reproduction, particularly in the degree of saturation of the pure color of blue, green and yellow as described in the aforesaid patent specifications. This effect is known as the interlayer effect or the interlayer development inhibition effect and is well known in the field of color photography. This effect is the effect that the color contrast is reduced in the case of exposing to white light than the case of exposing a monochromatic light, whereby the saturation of the monochromatic light color is increased when the gradation or the hue for white light is adjusted to a proper grey gradation as described in W. T. Hanson & C. A. Horton, *Journal of the Optical Society of America.* 42, pages 663 to 669 (1952) or A. Thiels, *Zeitschrifts fur Wissenschaftliche Photographic. Photophysik und Photochemie.* 47, pages 106 to 118 and pages 246 to 255 (1952).

As the photographic couplers, acylacetanilide series yellow couplers, pyrazolone series, pyrazolobenzimidazole series or pyrazolotriazole series magenta couplers, or naphthol series or phenol series couplers are frequently used, but the dyes formed by the coupling reaction thereof with the oxidation product of an aromatic primary amine color developing agent have undesirable side absorptions in addition to the main absorption thereof, although the extent thereof may differ, to some extent, from one dye to another. These undesirable side absorptions cause a reduction in saturation owing to the reduction in color contrast for monochromatic light in the case of establishing a proper gradation for white light.

As a technique for compensating the reduction in saturation by the undesirable absorption of the colored dyes as described above, there is known a method of using so-called colored couplers, as described, e.g., in U.S. Pat. No. 2,521,908.

On the other hand, the same effect as described above can be also obtained by applying the interlayer effect using the DIR coupler compounds disclosed in the aforesaid patent specifications.

The recent trend in increasing image quality in color photographic light-sensitive materials, and particularly the great progress in color reproduction, is largely due to making use of the interlayer effect. In particular, there has been a trend of increasing the interlayer effect in color photographic light-sensitive materials, and technical progress with respect thereto has largely contributed to the improvement of saturation.

However, in the case of reproducing color images on a color photographic light-sensitive material using color images formed on a color negative photographic film showing a large interlayer effect, color images having high saturation are obtained, but on the other hand, the following disadvantages sometimes occur. That is, in the case of photographing an object having primary colors of high purity using a color negative photographic film and then reproducing proper grey on a color photographic paper, a phenomenon occurs wherein the shade and shadow of the primary colors are not properly reproduced and gradation is lost.

The cause of the gradation loss is as follows. That is, since the saturation of, in particular, pure color is increased by the large interlayer effect as described above, (a) gradation does not exist at the high density portion on a color photographic paper, or a flattened density portion of a color photographic paper, which cannot perceive density differences is used, or, in other words, the reproduced density region of a color negative photographic film for pure color corresponds to the portion shifted from the reproduced exposure amount region of a color photographic paper to a high exposure amount side. Furthermore, (b) owing to an increased satuaration, the complementary color for the pure color is not printed on a color photographic paper and the shade is not reproduced or, in other words as above, the reproduced density region of a color negative photographic film corresponds to the portion shifted from the reproduced exposure amount region of a color photographic paper to a low exposure amount side.

This is explained further based on the following practical example. When a clear red and blue object which is shaded is photographed using a color negative photographic film having a large development inhibiting effect for a red-sensitive emulsion layer provided from other silver halide emulsion layers and a large development inhibiting effect for other silver halide emulsion layers provided from the red-sensitive emulsion layer, or a color negative photographic film having a large development inhibiting effect for a blue-sensitive emulsion layer provided from other silver halide emulsion layer and a large development inhibiting effect for other silver halide emulsion layers provided from the blue-sensitive emulsion layer, there occur the following phenomena. In the former case, the saturation is increased, caused by the large inhibiting effect provided from other emulsion layers; that is, cyan is reluctant to be reproduced in the color print obtained, and the saturation is also increased by the large inhibiting effect provided to other emulsion layers, and thus magenta and yellow are liable to be reproduced in the color print obtained to provide clear red. Similarly, in the latter case, yellow is reluctant to be reproduced in the color print and the saturation is increased, and cyan and magenta are liable to be reproduced to increase the saturation of blue. However, if the aforesaid development inhibiting effect of color print, that is, the interlayer effect is further increased, the saturation of magenta and yellow for a red object is too high to reproduce the shade thereof as well as cyan is not reproduced in the color print and the delicate shadow in red cannot be reproduced. Also, the saturation of cyan and magenta for a blue object is too high to reproduce the shade as well as yellow is not reproduced in the color print and the shadow cannot be reproduced. The above-described explanation is applicable not only for a red or blue object, but also by analogy for a green or yellow object.

The phenomenon that a shade or shadow is not reproduced and gradation is lost is specific to an object of primary color having high saturation and also is specific to a color photographic light-sensitive material having large interlayer effect.

Considering the importance of the interlayer effect as a recent technique for increasing image quality of color photographic light-sensitive materials, it is very desirable to eliminate such "gradation loss" phenomenon.

For avoiding the occurrence of "gradation loss" phenomenon, various means, such as that the interlayer effect itself is reduced, the spectral sensitization distribution of a photographic light-sensitive material is changed, and coloring materials are mixed that have hitherto been known, but such means are all accompanied by a reduction in saturation. Accordingly, it has been desired to develop a means for eliminating the foregoing disadvantages without reducing the merit of avoiding the occurrence of "gradation loss" phenomenon.

SUMMARY OF THE INVENTION

An object of this invention, therefore, is to provide a silver halide color photographic material having good color reproducing properties.

Other object of this invention is to provide a silver halide color photographic material capable of reproducing good tone in a high density region.

A further object of this invention is to provide a silver halide color photographic material showing high saturation in low density regions and in middle density regions, and also showing excellent reproduction of shade in a high density region.

It has now been discovered that the above-described objects can be attained by the present invention.

That is, according to this invention, there is provides a multilayer silver halide color photographic material comprising a support having thereon at least two light-sensitive silver halide emulsion layers, each having a different color sensitivity, and having associated therewith dye-forming agents forming imaging dyes, each having different hue, wherein at least one dye of a hue substantially not contributing to the formation of the hue of a specific image of a region in which the image density of at least one of said imaging dyes is over a definite density value of from 1.2 to 2.5 is provided so as to provide gradation to the specific image region.

According to a specific preferred embodiment of this invention, there is provided a multilayer silver halide color photographic material comprising a support having thereon a cyan-coloring coupler-containing red-sensitive silver halide emulsion layer, a magenta-coloring coupler-containing green-sensitive silver halide emulsion layer, and a yellow-coloring coupler-containing blue-sensitive silver halide emulsion layer, wherein a cyan gradation is added to a specific image region in which the density of a magenta image is over a definite density value of from 1.2 to 2.5.

DESCRIPTION OF PREFERRED EMBODIMENTS

Figure 1:
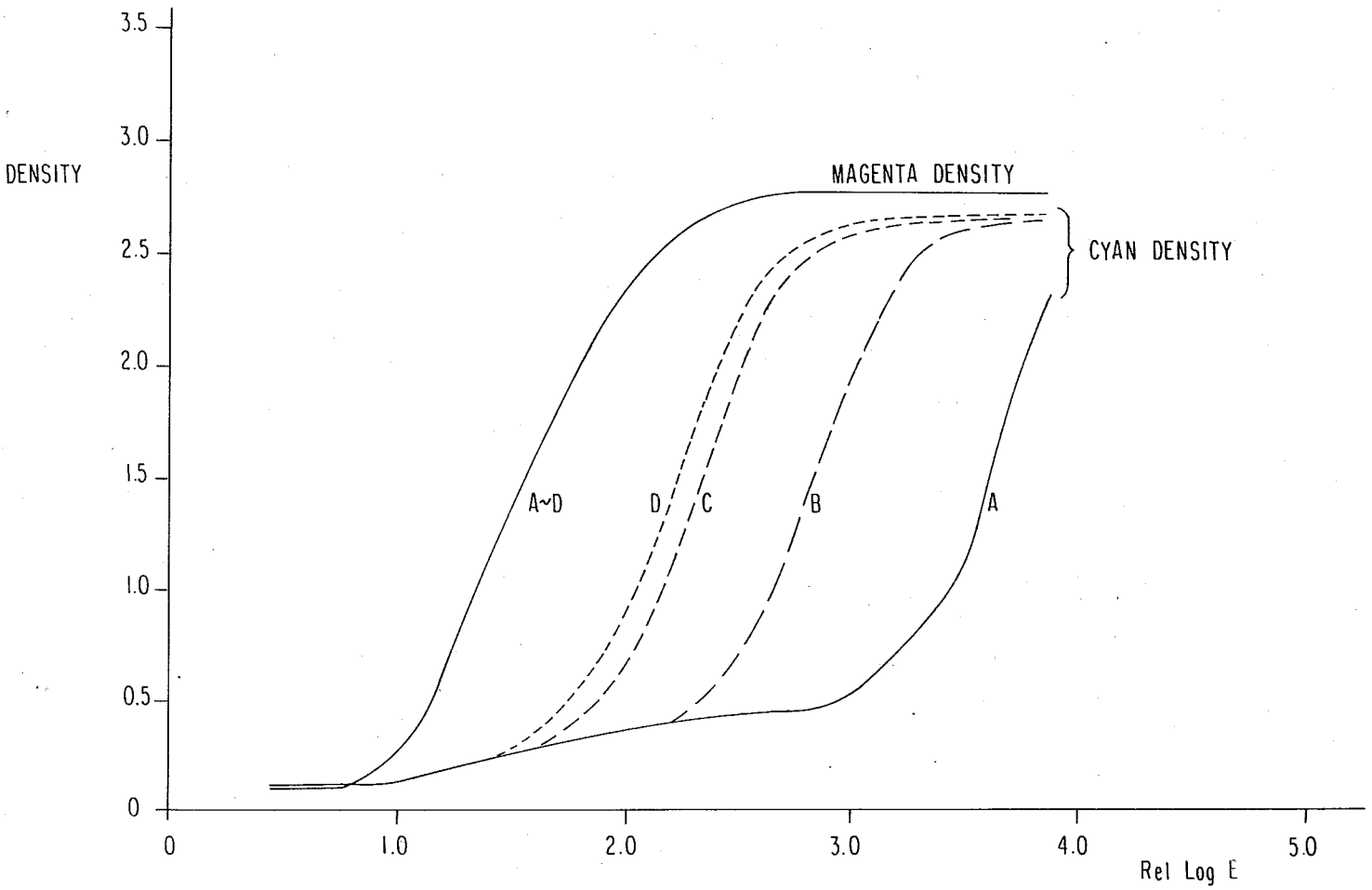
FIG. 1 is a graph showing characteristic curves of magenta density and cyan density.

When complementary colors of high saturation colors, in particular, yellow and/or magenta of an ordinary object to be photographed by a photographing color photographic light-sensitive material are partially or wholly added to a specific hue region that the image densities of the high saturation colors are over 1.2, a shade is added to the reproduced image of the object without reducing the saturation of the color(s). In an object or a density region wherein saturation is increased by the interlayer effect, etc., to cause gradation loss, a gradation usually appears by the addition of a complementary color. Accordingly, if a gradation is obtained by the addition of complementary color, and, thereby, a shade can be reproduced, it is very effective since the "gradation loss" phenomenon can be eliminated without reducing saturation.

The constitution of the silver halide color photographic material attaining the aforesaid objects of this invention can be practically realized, e.g., in the following manner.

1. At least one emulsion layer of a color photographic light-sensitive material having a cyan-coloring red-sensitive emulsion layer, a magenta-coloring green-sensitive emulsion layer, and a yellow-coloring blue-sensitive emulsion layer is spectrally sensitized for a wavelength region corresponding to a part or the whole of the complementary colors of the spectral sensitization distribution thereof, wherein the sensitivity of said emulsion layer is adjusted to a value properly lower than those of other light-sensitive emulsion layer(s) which are fundamentally sensitive to an exposure light corresponding to the complementary color. The above sensitivity means that another light-sensitive emulsion layer(s) which is fundamentally sensitive starts the coloring at the density value of from 1.2 to 2.5.

2. At least one layer of the red-sensitive emulsion layer, the green-sensitive emulsion layer, and the blue-sensitive emulsion layer of the color photographic light-sensitive material is constructed of a high-speed emulsion layer and a low-speed emulsion layer, wherein dye-forming agents (hereinafter referred to as coloring materials) are incorporated in these emulsion layers in such a manner that, in the high-speed emulsion layer, the complementary color to the color of sensitive light for the high-speed emulsion layer is formed, and, in the low-speed emulsion layer, the complementary color to the color of the sensitive light for the low-speed emulsion layer and colors other than the complementary color are simultaneously formed.

3. At least one layer of the red-sensitive emulsion layer, the green-sensitive emulsion layer, and the blue-sensitive emulsion layer is constructed of a high-speed emulsion layer and a low-speed emulsion layer, wherein the low-speed emulsion layer is disposed adjacent to another color-sensitive emulsion layer so as to easily diffuse the oxidation product of a color developing agent from the low-sensitive layer to the other emulsion layer, or an interlayer having only a limited color mixing preventing faculty is formed between the low-speed emulsion layer and the color-sensitive emulsion layer which is disposed to diffuse the oxidation product of a color developing agent.

4. At least one layer of the red-sensitive emulsion layer, the green-sensitive emulsion layer, and the blue-sensitive emulsion layer is constructed of a high-speed emulsion layer and a low-speed emulsion layer, wherein a diffusible development accelerator releasing coupler is incorporated in the low-speed emulsion layer and the released development accelerator is diffused over a color mixing preventing layer.

The above described means may be used as a proper combination thereof, such as a combination of above means 1 and 2, and in addition to the light-sensitive emulsion layer which forms a complementary color for a color of ordinary sensitive light, a light-sensitive emulsion layer which forms a part or whole of colors other than the complementary color is additionally formed.

In any means, a part or the whole of complementary color(s) for a certain dye must be added so as to provide gradation to a density region such that the image density of the dye is over a definite density set from 1.2 to 2.5. When, the complementary color(s) is added in a density region of higher than 2.5 good reproduction of a shade in a high density region according to this invention cannot be realized, while when the complementary color(s) is added in a density region of lower than 1.2, saturation of clear color is reduced. The density region in which the complementary color(s) is provided in preferably from 1.3 to 2.0, and more preferably from 1.4 to 1.6.

This invention can be applied for color photographic papers, color photographic printing films, color photographic positive films, etc., which are used for printing a color negative film showing large interlayer effect. If the interlayer effect is large, the above-described means of this invention can be applied for color reversal films and color reversal papers. In the case of a transmission type color photographic light-sensitive material, a better result is obtained when the density region in which the complementary color(s) is added is slightly higher than the density region in the case of a reflection-type light-sensitive material.

In commercially available color negative light-sensitive materials, the red-sensitive emulsion layer frequently shows a large interlayer effect and a particularly good result is obtained by applying this invention for avoiding the occurrence of gradation loss of red having high saturation.

When the present invention is applied for a color photographic light-sensitive material for prints, it is necessary to use the printing light-sensitive material fitting for the photographic characteristics of a negative photographic film which is printed to the printing light-sensitive material.

For example, for avoiding the occurrence of gradation loss of red having high saturation, a printing light-sensitive material is used wherein a cyan gradation is added when the magenta density becomes over a definite value from 1.2 to 2.5.

Similarly, in the case of a negative photographic film which is liable to cause a gradation loss of green or blue having high saturation, a color photographic light-sensitive material for prints wherein magenta or yellow gradation is added to the color prints, respectively, is preferably used.

This invention can be applied for various kinds of multilayer silver halide color photographic light-sensitive materials, preferably for color photographic light-sensitive materials for prints. Typical examples thereof are color photographic papers, reversal color photographic papers, color photographic positive films, and color light-sensitive materials for back illumination-type large-sized color prints.

When the invention is applied for a color photographic paper which is used for printing a color negative film having improved color contrast by an interlayer effect, an excellent effect is obtained for the reproduction of tone. As photographing color negative films showing a large interlayer effect, there are negative photographic films containing the DIR couplers as described in U.S. Pat. No. 4,477,563.

The coloring materials (dye-forming agents) for use in the silver halide color photographic materials of this invention include (a) couplers capable of forming colored dyes by causing coupling with the oxidation product of an aromatic primary amine developing agent, and (b) dye releasing compounds releasing dyes by a redox reaction with the oxidation product of a black and white developing agent such as 3-pyrazolones, etc.

In this invention, various color couplers can be used. "Color coupler" in this invention means a compound capable of forming a dye by reacting with the oxidation product of an aromatic primary amine developing agent.

Typical examples of the useful color couplers are naphthol or phenol series compounds, pyrazolone or pyrazoloazole series compounds, and open chain or heterocyclic ketomethylene compounds. Specific examples of cyan, magenta and yellow couplers for use in this invention are described in the patent specifications cited in *Research Disclosure,* RD No. 17643 (December 1978), paragraph VI-D and ibid., RD No. 18717 (November. 1979).

It is preferred that these polymers have a ballast group, and that polymerized couplers having diffusion resistance. It is preferred that the coupling position of the coupler is substituted by a coupling-releasable group. Couplers providing colored dyes having suitable diffusibility, colored couplers, non-coloring couplers, or couplers releasing a development inhibitor or a development accelerator upon occurrence of the coupling reaction can be also used in this invention.

Typical examples of the yellow couplers for use in this invention are oil-protected type acylacetamido couplers. Specific examples of such couplers are described, for example, in U.S. Pat. Nos. 2,407,210, 2,875,057, 3,265,506, etc.

In this invention, two-equivalent yellow couplers are preferably used, and specific examples of such yellow couplers are oxygen atom-releasing type yellow couplers described in U.S. Pat. Nos. 3,408,194, 3,447,928, 3,933,501, 4,401,752, etc.; and nitrogen atom-releasing type yellow couplers described in Japanese Patent Publication No. 10739/83, U.S. Pat. Nos. 4,022,620, 4,326,024, *Research Disclosure,* RD No. 18053 (April 1979), British Pat. No. 1,425,020, West German Patent Application (OLS) Nos. 2,219,917, 2,261,361, 2,329,587, 2,433,812, etc. Moreover, α-pivaloyl acetanilide series couplers have the desirable feature of the fastness of colored dyes, and on the other hand, α-benzoylacetanilide series couplers have the feature in good coloring property.

Examples of magenta couplers for use in this invention are oil-protected type indazolo series couplers or cyanoacetyl series couplers, preferably pyrazoloazole series couplers such as 5-pyrazolone series couplers and pyrazolotriazole series couplers. As the 5-pyrazolone series couplers, couplers wherein the 3-position is substituted by an arylamino group or an acylamino group are preferred from the viewpoints of hue and the coloring speed of the colored dyes. Specific examples of these couplers are described in U.S. Pat. Nos. 2,311,082, 2,343,703, 2,600,788, 2,908,573, 3,062,653, 3,152,896, 3,936,015, etc. Preferred examples of the two-equivalent 5-pyrazolone type couplers include a nitrogen atom-releasing group as described in U.S. Pat. No. 4,310,619 or an arylthio group as described in U.S. Pat. No. 4,351,897 as the releasing group. Also, 5-pyrazolone type couplers having a ballast group as described in European Pat. No. 73,636 have a high coloring reactivity.

As the pyrazoloazole series couplers for use in this invention, there are pyrazolo[1,5-b][1,2,4]triazoles described in European Patent Application (Unexamined publication) No. 119,860; pyrazolobenzimidazoles described in U.S. Pat. No. 3,369,897, preferably pyrazolotetrazoles described in *Research Disclosure,* RD No. 24220 (June 1984); and pyrazolopyrazoles described in *Research Disclosure,* RD No. 24230 (June 1984). The imidazopyrazoles described in Japanese Patent Application (OPI) No. 162548/84 (the term "OPI" as used herein refers to a "published unexamined Japanese patent application") and the aforesaid pyrazolo[1,5-b][1,2,4]triazoles are most preferred owing to the less yellow side absorption of the colored dyes and light fastness of the dyes.

As the cyan couplers for use in this invention, oil-protected type naphthol or phenol couplers can be used. Specific examples of these cyan couplers include naphthol type couplers as described in U.S. Pat. No. 2,474,293, preferably the oxygen atom-releasing type highly active two-equivalent naphthol type couplers as described in U.S. Pat. Nos. 4,052,212, 4,146,396, 4,228,233 and 4,296,200. Also, specific examples of the phenol type couplers are described in U.S. Pat. Nos. 2,369,929, 2,423,730, 2,772,162, 2,801,171, and 2,895,826.

Cyan couplers having fastness to humidity and heat are preferably used in this invention and typical examples of these couplers are phenol type cyan couplers as described in U.S. Pat. No. 3,772,002, 2,5-diacylamino-substituted phenol type couplers as described in U.S. Pat. Nos. 2,772,162, 3,758,308, 4,126,396. 4,334,011, 4,327,173, West German Patent Application (OLS) No. 3,329,729, and Japanese Patent Application (OPI) No. 166956/84 and phenol type couplers having a phenylureido group at the 2-position and an acylamino group at the 5-position as described in U.S. Pat. Nos. 3,446,622, 4,333,999, 4,451,559 and 4,427,767.

The aforesaid couplers may be used in the same emulsion layer as a combination of two or more kinds thereof for meeting the characteristics required for the color photographic light-sensitive materials of this invention, and the same coupler may be used in two or more emulsion layers.

For correcting the unnecessary absorption of the colored dyes of magenta and cyan couplers at a short wavelength region, it is preferred to use colored couplers together with the aforesaid couplers for the photographing color photographic light-sensitive materials of this invention. Typical examples of such colored couplers are yellow-colored magenta couplers as described in U.S. Pat. No. 4,163,670 and Japanese Patent Publication No. 39413/82, and magenta-colored cyan couplers as described in U.S. Pat. Nos. 4,004,929, 4,138,258, and British Pat. No. 1,146,368.

These color couplers may form dimers or higher oligomers. Typical examples of the polymerized couplers are described in U.S. Pat. Nos. 3,451,820, 4,080,211, etc. Also, specific examples of polymerized magenta couplers are described in British Pat. No. 2,102,173 and U.S. Pat. No. 4,367,282.

Also, in this invention, the graininess of the photographic light-sensitive materials of this invention can be improved by using colored dye-diffusing type couplers together with the above-described couplers. In regard to these couplers, specific examples of the magenta couplers are described in U.S. Pat. No. 4,366,237 and British Pat. No. 2,125,570 and specific examples of the yellow, magenta and cyan couplers are described in European Pat. No. 96,873 and West German Patent Application (OLS) No. 3,324,533.

The couplers for use in this invention can be introduced into photographic light-sensitive materials by various dispersion methods, such as, for example, a solid dispersion method, an alkali dispersion method, preferably a latex dispersion method, and more preferably an oil drop-in-water dispersion method. In the oil drop-in-water dispersion method, the coupler is dissolved in a high-boiling point organic solvent having a boiling point of higher than 175° C., and/or a low-boiling point so-called auxiliary solvent and then finely dispersed in an aqueous medium such as water and an aqueous gelatin solution in the presence of a surface active agent. Examples of the high-boiling organic solvents are described in U.S. Pat. No. 2,322,027, etc. The dispersion may be formed attended with phase transfer. Also, if necessary, the dispersion may be coated after removing or reducing the auxiliary solvent therefrom by distillation, noodle washing, ultrafiltration, etc., before coating.

Specific examples of the high-boiling organic solvents are phthalic acid esters (e.g., dibutyl phthalate, dicyclohexyl phthalate, di-2-ethylhexyl phthalate, didodecyl phthalate, etc.), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecylpyrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

Also as the auxiliary solvents, organic solvents having boiling points of from about 30° C. to about 160° C. can be used. Specific examples thereof include ethyl acetate, butyl acetate, ethyl propionate, methyl ethyl ketone, cyclohexanone, 2-ethoxyethyl acetate, dimethylformamide, etc.

Specific examples of the latex dispersion method, the effect thereof, and the latexes for impregnation are described in U.S. Pat. No. 4,199,363, West German Patent Application (OLS) Nos. 2,541,274, 2,541,230, etc.

As the dye-releasing compounds for use in this invention, compounds capable of imagewise forming a diffusible dye or a precursor thereof as the result of development are used. For example, a non-diffusible coupler releasing a dye developing agent or a diffusible dye can be used, but a dye releasing redox compound (commonly known as a DRR compound) is preferably used.

The DRR compounds which can be used in the present invention are immobile under alkaline processing conditions, and are generally represented by formula (I)

$$\text{(Ballast)}\text{-}\text{(Link)}\text{-}\text{(Dye)} \qquad \text{(I)}$$

wherein, (Ballast) represents a ballast group for immobilizing the DRR compound under an alkaline processing condition; (Dye) represents a dye group capable of moving in a photographic layer under an alkaline processing condition, or a precursor thereof; and (Link) represents a redox cleavable group which is split off (negative type) or inhibited from splitting off (positive type) upon oxidation accompanied by development.

Examples of the negative type "Link" group are described, e.g., in U.S. Pat. Nos. 4,053,312, 4,135,929 and 4,336,322, Japanese Patent Application (OPI) Nos. 33826/73, 104343/76, 46730/78, 130122/79, 113624/76, 12642/81, 161131/81, 4043/82, 650/82, 20735/82, 54021/79, 71072/81, etc. One specific but not limitative example thereof is an N-substituted sulfamoyl group, with a preferred substituent being an aryl group, as in the specific examples of (Ballast)-(Link)-shown below., Specific examples of (Ballast)-(Link)-which can release a diffusible dye are set forth below.

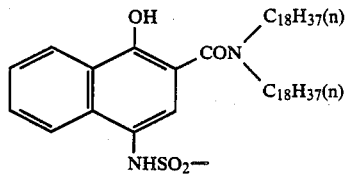

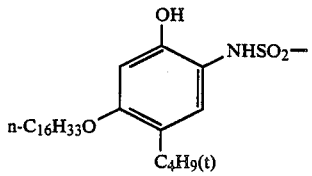

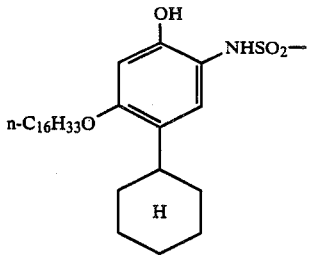

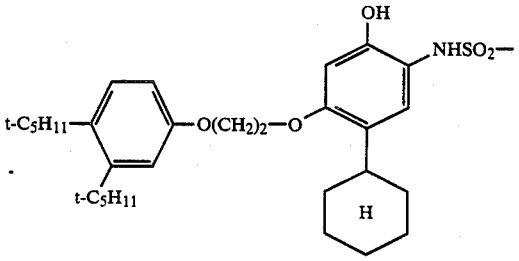

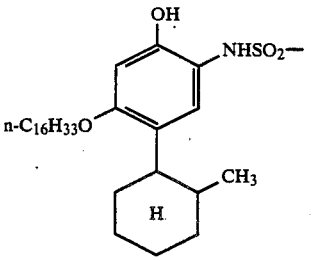

The dyes released from the DRR compounds may be either complete dyes or dye precursors that can be converted to dyes during photographic processing steps or following-up processing steps. The final image dyes may or may not be chelated. Typical examples of the dyes are chelated or non-chelated azo dyes, azomethine dyes, anthraquinone dyes or phthalocyanine dyes. Of these, cyan, magenta, and yellow azo dyes are particularly useful.

Specific examples of yellow dyes are described in U.S. Pat. Nos. 3,597,200, 3,309,199, 4,013,633, 4,139,383, 4,156,609, 4,195,992, 4,148,641, 4,148,643, 4,245,028 and 4,336,322, Japanese Patent Application (OPI) Nos. 114930/76 and 71072/81, *Research Disclo-*

*sure,* RD No. 17630 (December 1978), ibid., RD No. 16475 (December 1977), etc.

Specific examples of the magenta dyes are described in U.S. Pat. Nos. 3,453,107, 3,544,545, 3,932,380, 3,931,144, 3,932,308, 3,954,476, 4,142,891, 4,207,104, 4,233,237, 4,250,246, 4,255,509 and 4,287,292, Japanese Patent Application (OPI) Nos. 106727/77, 23628/78, 36804/80, 73057/81, 71060/81, 134/80, etc.

Specific examples of cyan dyes are described in U.S. Pat. Nos. 3,482,972, 3,929,760, 4,013,635, 4,142,891, 4,147,544, 4,148,642, 4,171,220, 4,195,994, 4,242,435 and 4,268,625, British Pat. No. 1,551,138, Japanese Patent Application (OPI) Nos. 99431/79, 8827/77, 47823/78, 143323/78, 99431/79 and 71061/81, EPC Patents 53,037 and 53,040, *Research Disclosure,* RD No. 17630 (December 1978), ibid., RD No. 16475 (December 1977), etc.

As dye precursors, DRR compounds having a dye moiety having its light absorption temporarily shifted when present in a light-sensitive element can be used. Specific examples of such dye precursors are described in Japanese Patent Application (OPI) Nos. 53330/80 and 53329/80, U.S. Pat. Nos. 3,336,287, 3,579,334 and 3,982,946, British Pat. No. 1,467,317, etc.

Reproduction of natural color by a subtractive color process involves use of a light-sensitive material comprising at least a combination of an emulsion showing selective spectral sensitivity in a certain wavelength region and a DRR compound showing selective spectral sensitivity in the same wavelength region.

Light-sensitive materials comprising a combination of a blue-sensitive silver halide emulsion and a yellow DRR compound, a combination of a green-sensitive emulsion and a magenta DRR compound, and a combination of a red-sensitive emulsion and a cyan DRR compound are particularly useful. Each of these combination units may be provided in layers in the light-sensitive material so as to face to each other or may be formed in particles so that the DRR compound and the silver halide grains are present in the same particles, mixed together and coated in one layer.

This invention can be applied for a color printing photographic material showing high color separation with a high effect. For increasing color separation, it is effective to use an image-forming dye showing less side absorption. Practically, specific examples are a color printing photographic material containing a dye-forming agent releasing a monoazo series dye having a narrow half value width of absorption and showing less unnecessary absorption and a color printing photographic material containing a pyrazoloazole series coupler showing less unnecessary absorption.

The dye-forming agents for use in this invention can be combined with various combinations of color sensitivities of silver halides and this invention can be also applied to a color photographic light-sensitive material having, for example, an infrared-sensitive cyan-forming layer, a red-sensitive magenta-forming layer, and a green-sensitive yellow-forming layer in addition to the above-described photographic light-sensitive materials.

As the binder or protective colloid which can be used for the emulsion layers and interlayers, etc., of the photographic light-sensitive materials of this invention, gelatin is advantageously used but other hydrophilic colloids can be used individually or together with gelatin.

For the photographic emulsion layers of the photographic light-sensitive materials of this invention, silver bromide, silver iodobromide, silver iodochlorobromide, silver chlorobromide or silver chloride can be used as the silver halide. Preferred silver halide is silver iodobromide containing less than 15 mole% silver iodide. Particlarly preferred silver halide is silver iodobromide containing from 2 mole% to 12 mole% silver iodide.

There is no particular restriction on the mean grain size (indicated by the grain diameter when the grain is sphere or is near sphere, and indicated by the mean value based on the projection area employing the edge length as the grain size when the grain is cubic) of the silver halide grains in the photographic silver halide emulsions but the mean grain size is, preferably, less than 3 microns.

The grain size distribution may be narrow or broad.

The silver halide grains in the photographic silver halide emulsions for use in this invention may have regular crystal forms, such as cubic and octahedral, etc., or irregular crystal forms, such as spherical, tabular, etc. Furthermore, the silver halide grains may be a composite of various crystal forms, or may be composed of a mixture of silver halide grains having various crystal forms.

Moreover, a silver halide emulsion wherein tubular silver halide grains having a diameter larger than 5 times the thickness thereof account for at least 50 percent of the total projected areas of the silver halide grains may be used in this invention.

A silver halide photographic emulsion which can be used in the present invention can be manufactured according to a method as described, for example, in *Research Disclosure,* RD No. 17643 (December 1978), pages 22 to 23, "I. Emulsion Preparation and and Types" and ibid., RD No. 18716 (November 1979), pages 648.

Various photographic addenda which can be used in the present invention are described, for example, in *Research Disclosure,* RD. 17643 (December 1978), pages 23 to 28 and ibid, RD No. 18716 (November 1979), pages 648 to 651 as illustrated below.

| | Example of Addenda | RD No. 17643 Page | RD No. 18716 Page |
|---|---|---|---|
| (1) | Chemical Sensitizers | 23 | 648 right column |
| (2) | Speed-Increasing Compounds | | 648 right column |
| (3) | Spectral Sensitizers and Super Sensitizers | 23 to 24 | 648 right column to 649 right column |
| (4) | Antifoggants and Stabilizers | 24 to 25 | 649 right column |
| (5) | Light-Absorbing Material, Filter Dyes, Scattering Materials, and Ultraviolet Absorbers | 25 to 26 | 649 right column to 650 left column |
| (6) | Antistain Agents | 25 right column | 650 left to right column |
| (7) | Hardeners | 26 | 651 left column |
| (8) | Vehicles and Binding Agents | 26 | 651 left column |
| (9) | Plasticizers and Lubricants | 27 | 650 right column |
| (10) | Coating Aids such as Surfactants | 26 to 27 | 650 right column |
| (11) | Agents for Antistatic or Conducting Layers | 27 | 650 right column |

Suitable supports which can be used in the present invention are described, for example, in *Research Disclosure,* RD No. 17643 (December 1978), page 28 and ibid., RD No. 18716 (November 1979), page 647 right column to 648 left column.

A color photographic light-sensitive material according to the present invention can be processed by a conventional method as described, for example, in *Research Disclosure,* RD No. 17643 (December 1978), pages 28–29 and ibid., RD No. 18716 (November 1979), page 651, left to right columns.

The photographic material may be washed with water after color development and/or the bleach and fix processes or the blix (bleaching and fixing) process.

The color development is generally conducted at a temperature of from 18° C. to 55° C., preferably higher than 30° C., more preferably higher than 35° C. The developing time is as short as possible in a range of from about 1 minute to about 3.5 minutes.

For continuous development processing, it is preferably red to supply a fresh developer. In this case, the supplemental liquid is supplied in an amount of from 160 ml to 330 ml, preferably less than 100 ml per square meter of the processed area. It is preferred that the content of benzyl alcohol in the developer is less than 5 ml/liter.

The blix can be performed at temperatures of from 18° C. to 50° C., preferably higher than 30° C. When the blixing temperature is higher than 35° C., the processing time can be reduced to less than 1 minute, and the amount of the supplemental liquid can also be reduced. The time required for washing after color development or blix process is usually within 3 minutes and it can be reduced to within one minute by using a stabilization bath.

Colored dyes are generally deteriorated and faded by light, heat, and humidity, as well as by mold, during storage. The deterioration of cyan dye images by the action of mold is particularly severe and the use of an antimold agent is preferred. Specific examples of antimold agents are 2-thiazolylbenzimidazoles as described in Japanese Patent Application (OPI) No. 157244/82. The antimold agent may be incorporated in the photographic light-sensitive materials or may be incorporated therein from outside in a processing step. In other words, the antimold agent may be added to the photographic light-sensitive materials in any step provided that the antimold agent is present in the photographic materials after processing.

This invention particularly effective in the case of printing a color negative photographic light-sensitive material containing a so-called DIR couplers releasing a development inhibitor with the progress of development.

Examples of the DIR couplers are couplers releasing a heterocyclic mercapto series developing inhibitor as described, for example, in U.S. Pat. No. 3,227,554; couplers releasing a benzotriazole derivative as a development inhibitor as described, for example, in U.S. Pat. No. 4,095,984; so-called non-coloring DIR couplers as described, for example, in U.S. Pat. No. 3,958,993; couplers releasing a nitrogen-containing heterocyclic development inhibitor with the decomposition of methylol after releasing as described, for example, in U.S. Pat. No. 4,146,396; couplers releasing a development inhibitor with a intramolecular nucleophilic reaction after releasing as described, for example, in U.S. Pat. No. 4,248,962; couplers releasing a development inhibitor by an electron transfer through a covalent system after releasing as described, for example, in U.S. Pat. Nos. 4,409,323 and 4,421,845 and Japanese Patent Application (OPI) Nos. 56837/82, 188035/82, 98728/83, 209736/83, 209737/83, 209738/83, 209740/83, etc.; couplers releasing a diffusible development inhibitor the development inhibiting faculty of which is inactivated in a developer as described, for example, in U.S. Pat. No. 4,477,563 and Japanese Patent Application (OPI) No. 217932/83, etc.; and couplers releasing a reactive compound, which forms a development inhibitor or inactivates a development inhibitor by causing a reaction in emulsion layers at development, as described, for example, in Japanese Patent Application Nos. 38263/84, 39653/84, etc.

Preferred examples of the DIR couplers in the combination with this invention in the aforesaid couplers are developer inactivation type couplers as described in U.S. Pat. No. 4,477,563; timing type couplers as described in U.S. Pat. No. 4,421,845; and reactive type couplers as described in Japanese Patent Application No. 39653/84. Particularly preferred examples are the developer inactivation type DIR couplers as described in U.S. Pat. No. 4,477,563 and the reactive type DIR couplers described in Japanese Patent Application No. 39653/84.

Specific examples of DIR couplers which can be preferably used for the color negative photographic light-sensitive materials in the combination with this invention are illustrated below.

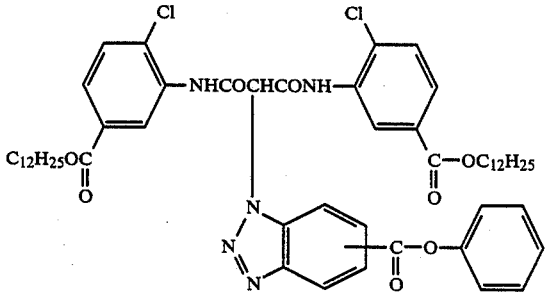

D-1

-continued
D-2
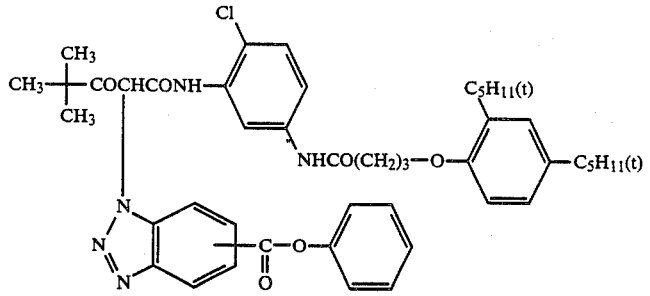
D-3
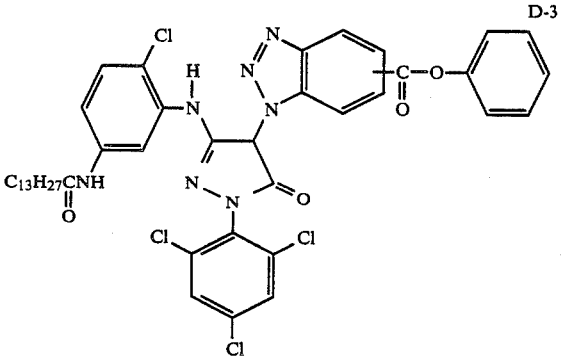
D-4
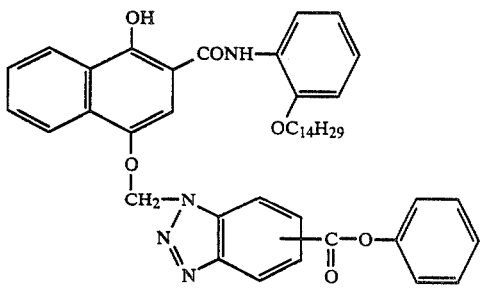
D-5
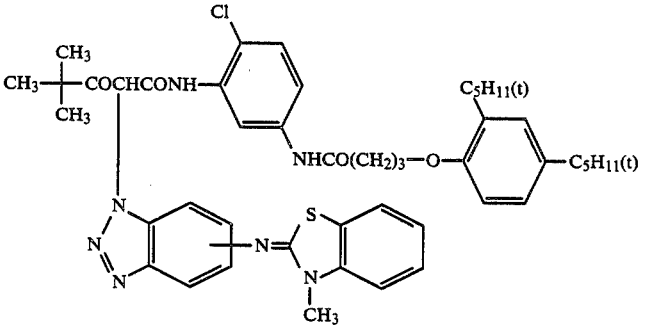
D-6
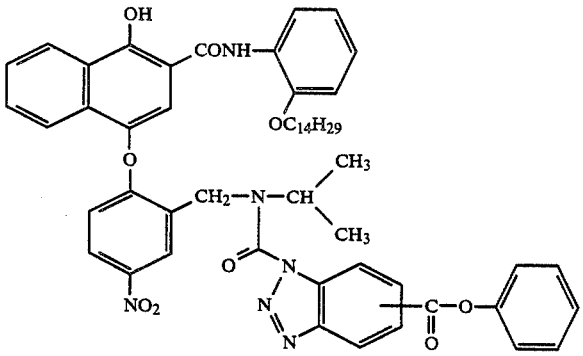
D-7
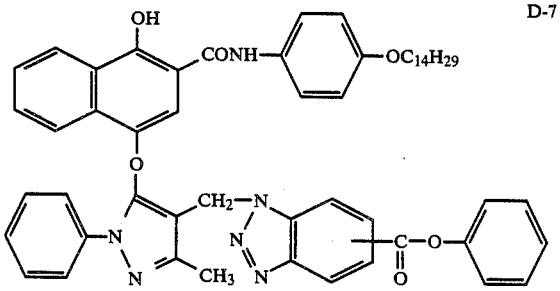
D-8
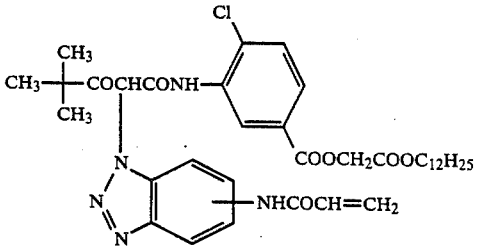

-continued
D-9
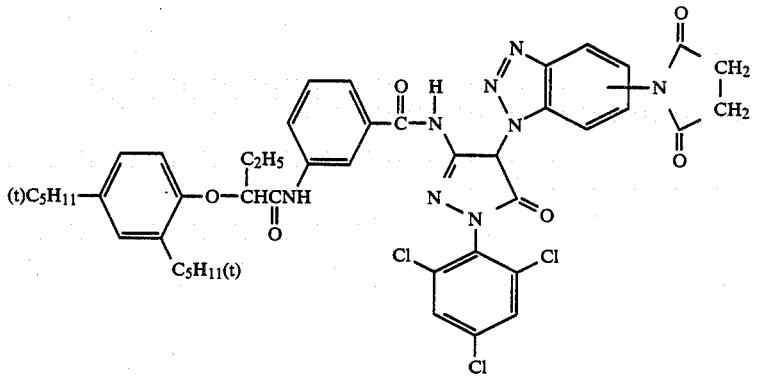
D-10
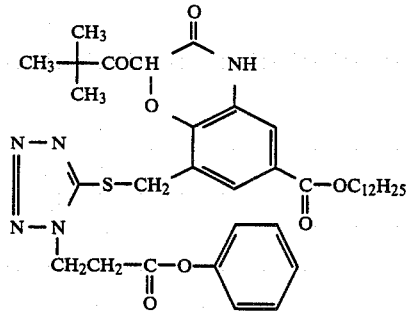
D-11
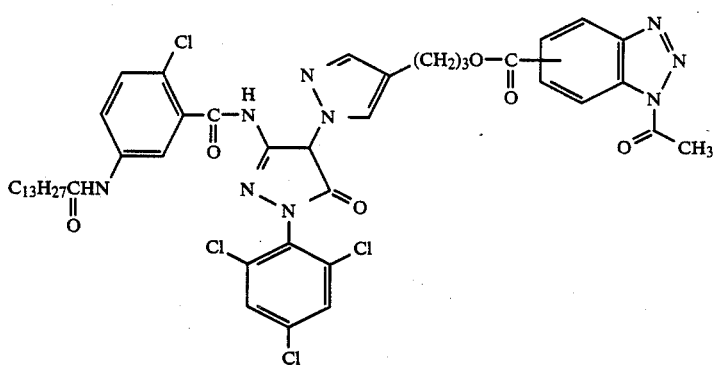
D-12
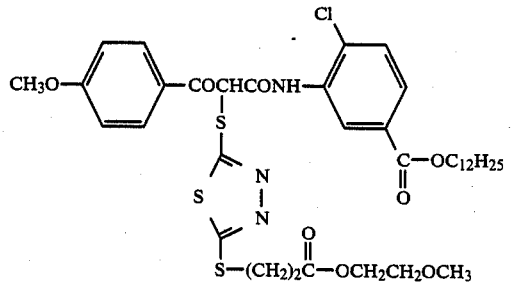

-continued
D-13
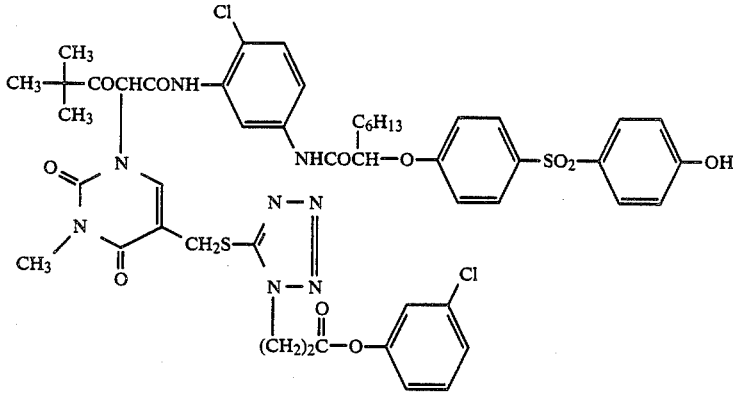
D-14
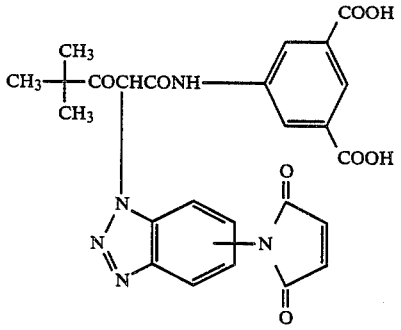
D-15
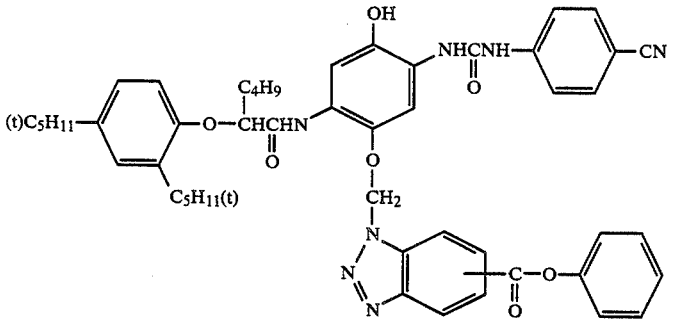
D-16
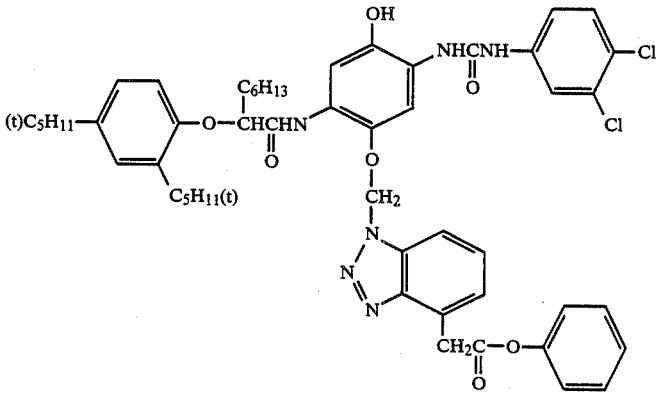

-continued
D-17
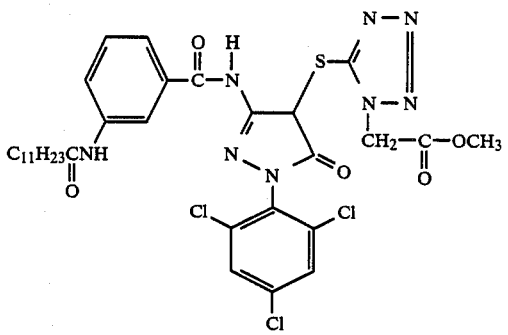
D-18
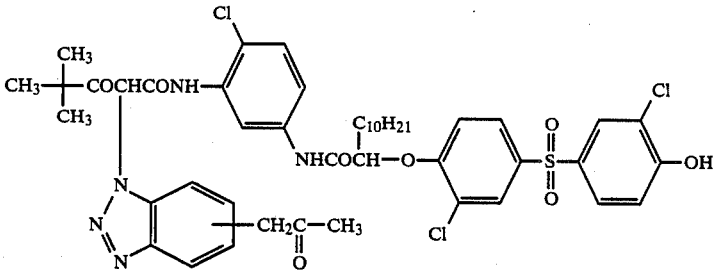
D-19
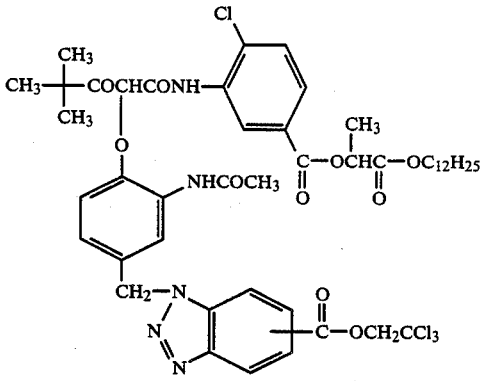
D-20
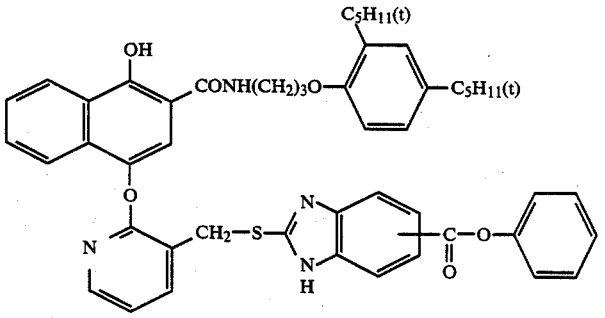

-continued
D-21
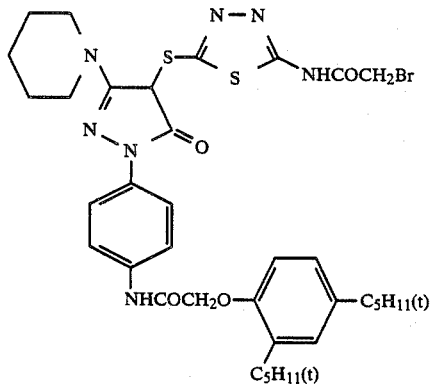
D-22
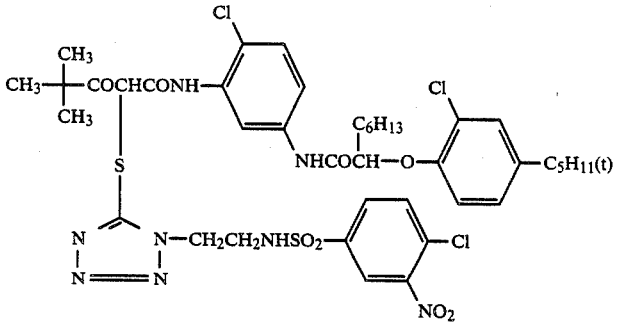
D-23
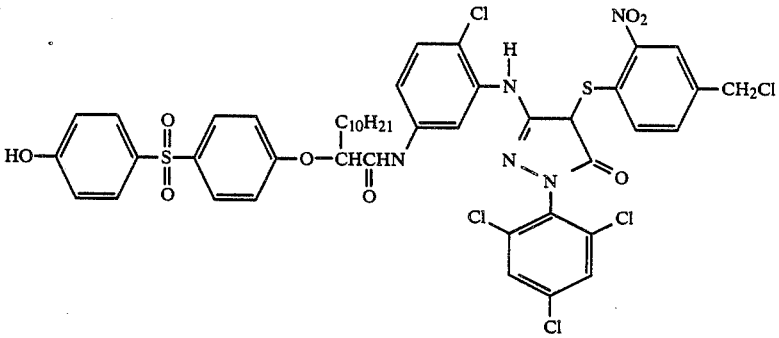
D-24
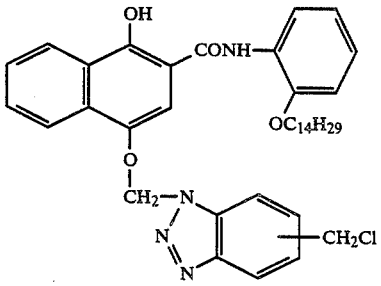

-continued
D-25
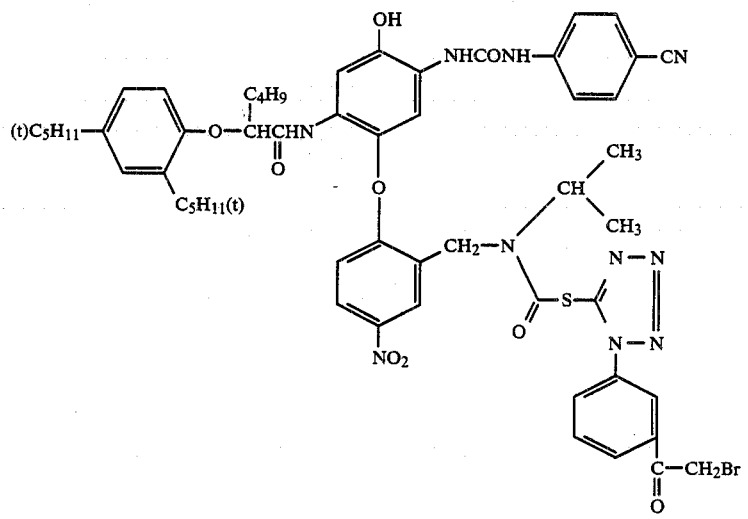
D-26
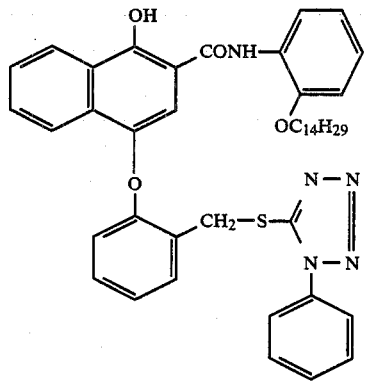
D-27
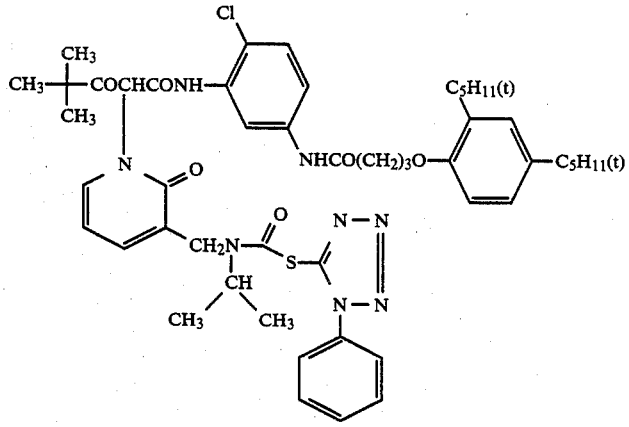

-continued
D-28
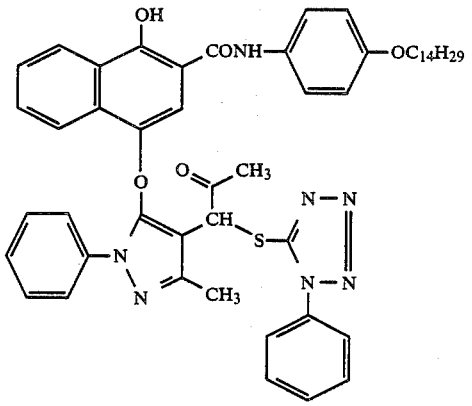
D-29
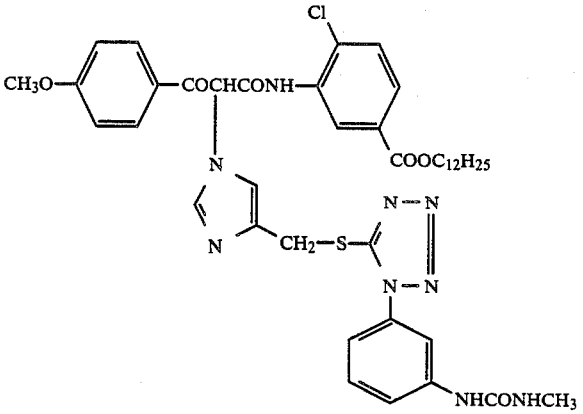
D-30
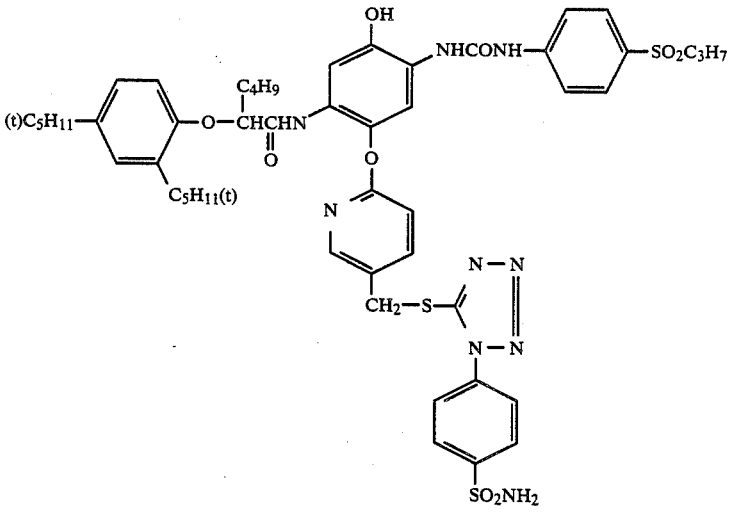

-continued
D-31
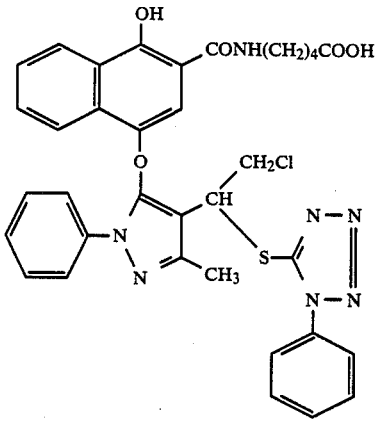
D-32
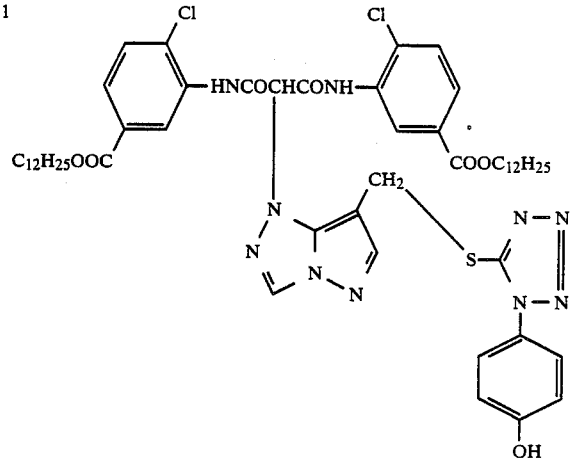
D-33
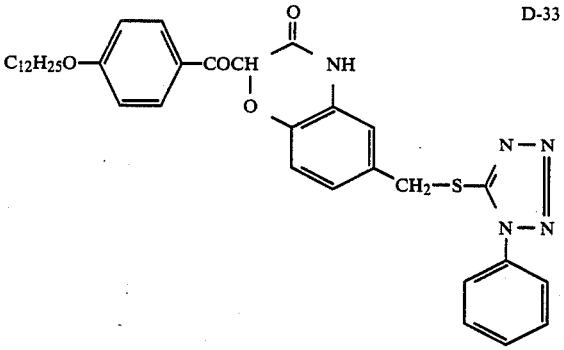
D-34
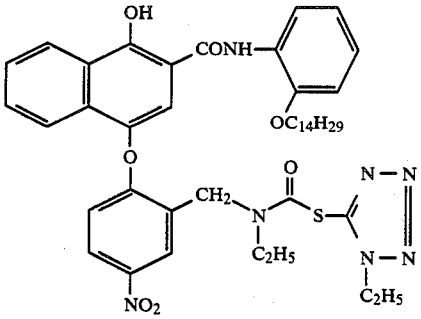
D-35
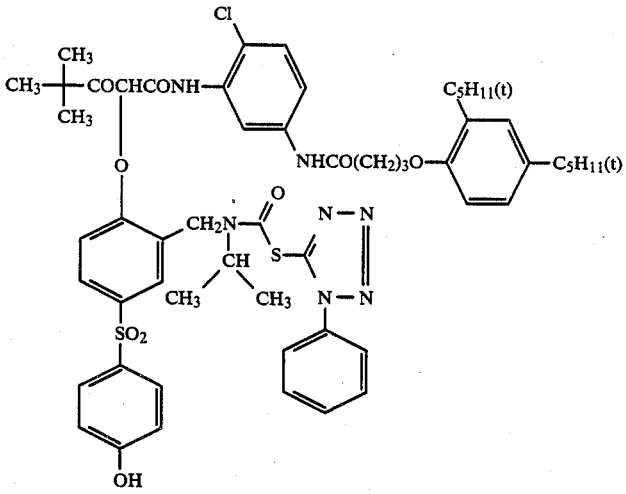
D-36
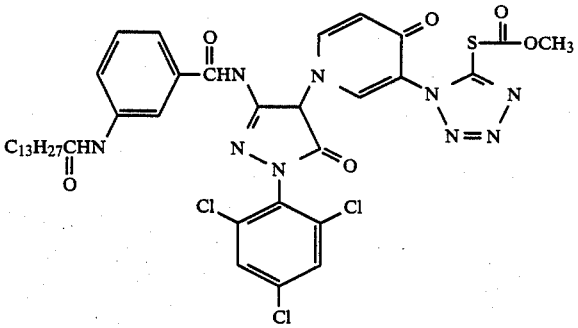

-continued

D-37

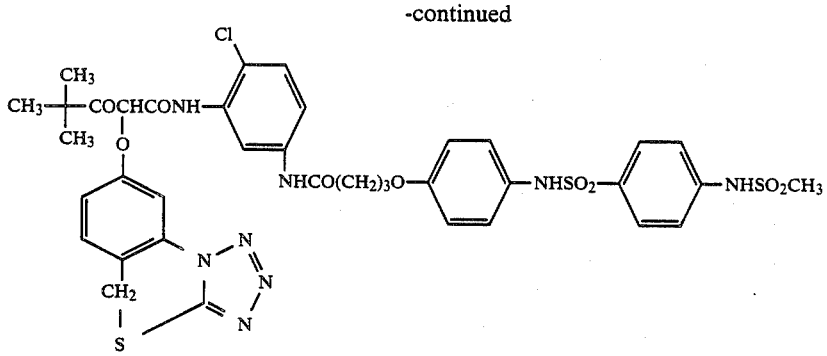

D-38

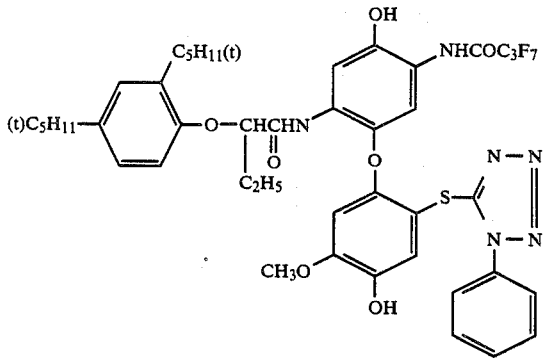

D-39

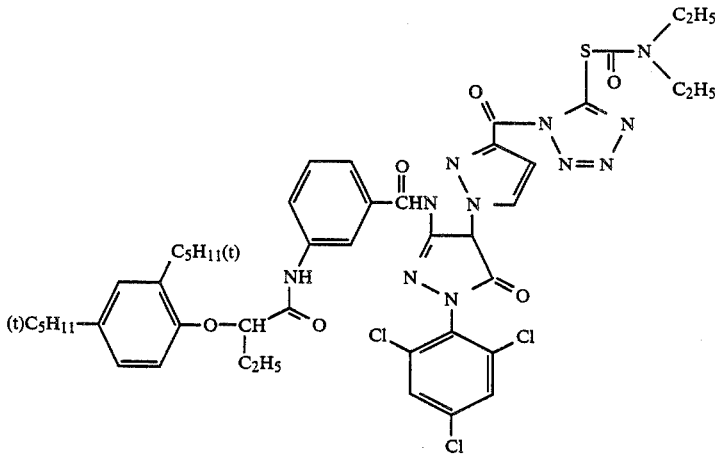

D-40

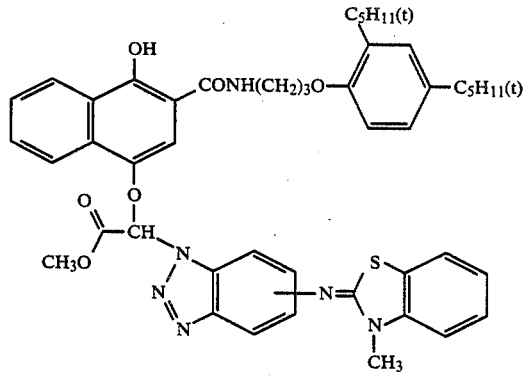

According to this invention, a silver halide color photographic material showing improved color reproduction is obtained. In particular, a silver halide color photographic light-sensitive material which can faithfully reproduce the sharpness of primary color from a low density region to a high density region and further reproduces even a delicate shade in the high density region of a primary color, and shows improved color reproduction and tone reproduction is obtained.

This invention is particulary effectively applied for color photographic papers, color positive photographic films, photographic films for giving back illumination large sized print films, or reversal color photographic papers for printing color negative photographic films having improved interlayer effect by the use of DIR couplers. In particular, this invention can be used with remarkable effect for printing a color negative photographic film using the aforesaid DIR couplers, paticulary, the developer inactivation type DIR couplers.

The invention can more improve the image quality of photographic light-sensitive materials for prints using clear dyes having a narrow half value width and less unnecessary absorption, and the invention is preferably applied in the case of using color photographic light-sensitive materials containing pyrazoloazoles, such as pyrazolo[1,5-b][1,2,4]triazole, as magenta couplers, or color photographic light-sensitive materials containing DRR compounds releasing a monoazo dye.

Then, the present invention will be explained in detail with the reference to the following examples but the invention should not be construed as being limited to these examples.

EXAMPLE 1

A color photographic light-sensitive material (Sample A) was prepared by successively coating Layer 1 (lower-most layer) through Layer 7 (uppermost layer) as shown below on a paper support having polyethylene layer laminated on both surfaces thereof.

Layer 1: Blue-sensitive emulsion layer:

A layer containing 40 mg/m$^2$ (as silver) of a silver chlorobromide emulsion (80 mole% silver bromide), 300 mg/m$^2$ of a yellow coupler*6, and 150 mg/m$^2$ of a coupler solver*7, and 1200 mg/m$^2$ of gelatin.

Layer 2: Interlayer:

A layer containing 1000 mg/m$^2$ of gelatin.

Layer 3: Green-sensitive emulsion layer:

A layer containing 200 mg/m$^2$ (as silver) of a silver chlorobromide emulsion (70 mole% silver bromide), 0.5 mg/m$^2$ of a spectral sensitizing dye*9, 300 mg/m$^2$ of a magenta coupler*4, 200 mg/m$^2$ of a coupler solvent*5, and 1000 mg/m$^2$ of gelatin.

Layer 4: Interlayer:

A layer containing 600 mg/m$^2$ of a ultraviolet absorbent*1, 300 mg/m$^2$ of a ultraviolet absorbent solvent*2, and 800 mg/m$^2$ of gelatin.

Layer 5: Red-sensitive emulsion layer:

A layer containing 300 mg/m$^2$ (as silver) of a silver chlorobromide emulsion (50 mole% silver bromide), 0.04 mg/m$^2$ of a spectral sensitizing dye*8, 400 mg/m$^2$ of a cyan coupler*3, 400 mg/m$^2$ of a coupler solvent*2, and 1000 mg/m$^2$ of gelatin.

Layer 6: Ultraviolet absorption layer:

A layer containing 600 mg/m$^2$ of a ultraviolet absorbent*1, 300 mg/m$^2$ of a ultraviolet absorbent solvent*2, and 800 mg/m$^2$ of gelatin.

Layer 7: Protective layer:

A layer containing 1000 mg/m$^2$ of gelatin.

The compounds used above were as follows:

(*1): Ultraviolet absorbent:

2-(2-Hydroxy-3-sec-butyl-5-tert-butylphenyl)benzotriazole (*2): Solvent:

Dibutyl phthalate (*3): Coupler:

2-[α-(2,4-di-tert-pentylphenoxy-butanamid]-4,5-dichloro-methylphenol (*4): Coupler:

1-(2,4,6-Trichlorophenyl)-3-(2-chloro-5-tetradecanamido)anilino-4-(2-butoxy-5-tert-octylphenylthio)-2-pyrazoline-5-one (*5): Solvent:

Tricresyl phosphate (*6): Coupler:

α-Pivaloyl-α-(2,4-dioxy-5,5'-dimethyloxazolidine-3-yl)-2-chloro-5-[α-(2,4-di-tertpentyloxy)butanamido]-acetanilide (*7): Solvent:

Dioctylbutyl phosphate (*8): Spectral sensitizing dye:

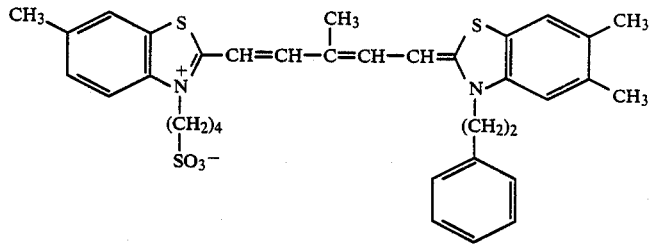

By following the same procedure as above except that 0.04, 0.11, and 0.18 mg/m$^2$, respectively of spectral sensitizing dye (*9) shown below was added to Layer 5 of Sample A in addition to the spectral sensitizing dye (*8), Samples B, C and D were prepared.

(*9): Spectral sensitizing dye:

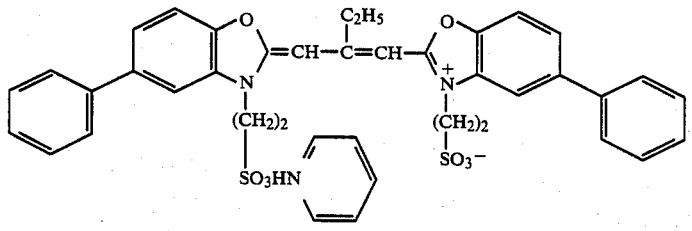

Each of the samples thus prepared was exposed to green light through a continuous wedge, developed as indicated below and then the density obtained was measured on each sample.

| Processing steps (33° C.): | |
|---|---|
| Color Development | 3 min. 30 sec. |
| Blix | 1 min. 30 sec. |
| Washing with water | 3 min. |
| Dry | 10 min. |

The compositions of the processing solutions used for the above processing step were as follows.

| | |
|---|---|
| Color Developer: | |
| Benzyl alcohol | 15 ml |
| Diethylene glycol | 5 ml |
| Potassium carbonate | 25 g |
| Sodium chloride | 0.1 g |
| Sodium bromide | 0.5 g |
| Anhydrous sodjum sulfite | 2 g |
| Hydroxylamine sulfate | 2 g |
| N—Ethyl-N—β-methanesulfonamidoethyl-3-methyl-4-aminoaniline sulfate | 4 g |
| Water to make | 1 liter |
| pH adjusted to 10 by adding NaOH | |
| Blix Solution: | |
| Ammonium thiosulfate | 124.5 g |
| Sodium metahydrogensulfite | 13.3 g |
| Anhydrous sodium sulfite | 2.7 g |
| Ammonium EDTA ferrate (III) dihydrate | 65 g |
| Water to make | 1 liter |
| pH adjusted to 6.8 | |

The results as shown in FIG. 1 were obtained.

From the results, it can be seen that the magenta density was almost the same in Samples A to D, but the cyan density which is different in Samples A to D was increased with the addition of the spectral sensitizing dye (*9), and a cyan density is added in Sample C higher than 1.5 of magenta density.

An object including a dress having a delicate shade in clear red was photographed using a color negative film providing a large interlayer effect onto the red-sensitive emulsion layer, and prints were prepared using Samples A to D. The results were as follows.

Sample A: Saturation was very high, the color reproduction of the red cloth was particularly clear, but the shade of the crease of the dress was difficult to distinguish.

Sample B: Substantially the same as Sample A.

Sample C: Saturation was very high, the color reproduction of, in particular, the red dress, was clear and the shade of crease, etc., was clearly seen.

Sample D: The shade of the crease of the red cloth was easy to see, but the saturation of red itself was low.

From the above results, it could be seen that in Sample C, the occurrence of "gradation loss" was prevented without reducing the color reproduction of high saturation.

EXAMPLE 2

A color photographic light-sensitive material (Sample E) was prepared by successively coating Layer 1 (lower-most layer) through Layer 9 (uppermost layer) on a paper support having polyethylene layer laminated on both surfaces thereof.

Layer 1: Blue-sensitive emulsion layer:

A layer containing 300 mg/m$^2$ (as silver) of a sivler chlorobromide emulsion (80 mole% silver bromide), 300 mg/m$^2$ of a yellow coupler*6, and 150 mg/m$^2$ of a coupler solvent*7, and 1200 mg/m$^2$ of gelatin.

Layer 2: Interlayer:

A layer containing 1000 mg/m$^2$ of gelatin.

Layer 3: Green-sensitive emulsion layer:

A layer containing 85 mg/m$^2$ (as silver) of a silver chlorobromide emulsion (70 mole% silver bromide, 0.3 mean grain size of silver halide), 130 mg/m$^2$ of a magenta coupler*4, 85 mg/m$^2$ of a coupler solvent*5, and 430 mg/m$^2$ of gelatin.

Layer 4: Interlayer:

A layer containing 1000 mg/m$^2$ of gelatin.

Layer 5: Green-sensitive emulsion layer:

A layer containing 115 mg/m$^2$ (as silver) of a silver chlorobromide emulsion (70 mole% silver bromide, 0.5 mean grain size of silver halide), 170 mg/m$^2$ of a magenta coupler*4, 115 mg/m$^2$ of a coupler solvent*5, and 570 mg/m$^2$ of gelatin.

Layer 6: Interlayer:

A layer containing 600 mg/m$^2$ of ultraviolet absorbent*1, 300 mg/m$^2$ of ultraviolet absorbent solvent*2, and 800 mg/m$^2$ of gelatin.

Layer 7: Red-sensitive layer:

A layer containing 250 mg/m$^2$ (as silver) of a silver chlorobromide emulsion (50 mole% silver bromide), 400 mg/m$^2$ of a cyan coupler*3, 400 mg/m$^2$ of a coupler solvent*2, and 1000 mg/m$^2$ of gelatin.

Layer 8: Ultraviolet absorption layer:

A layer containing 600 mg/m$^2$ of a ultraviolet absorbent*1, 300 mg/m$^2$ of a ultraviolet absorbent solvent*2, and 800 mg/m$^2$ of gelatin.

Layer 9: Protective layer:

A layer containing 1000 mg/m$^2$ of gelatin.

The compounds (*1) to (*7) used above were those described in Example 1.

By following the same procedure as above except that 15 mg/m$^2$ of the cyan coupler (*3) was added to Layer 3 of Sample E in addition to the magenta coupler (*4) and the amount of the cyan coupler in Layer 7 was reduced to 385 mg/m$^2$, Sample F was prepared.

Figure 2:
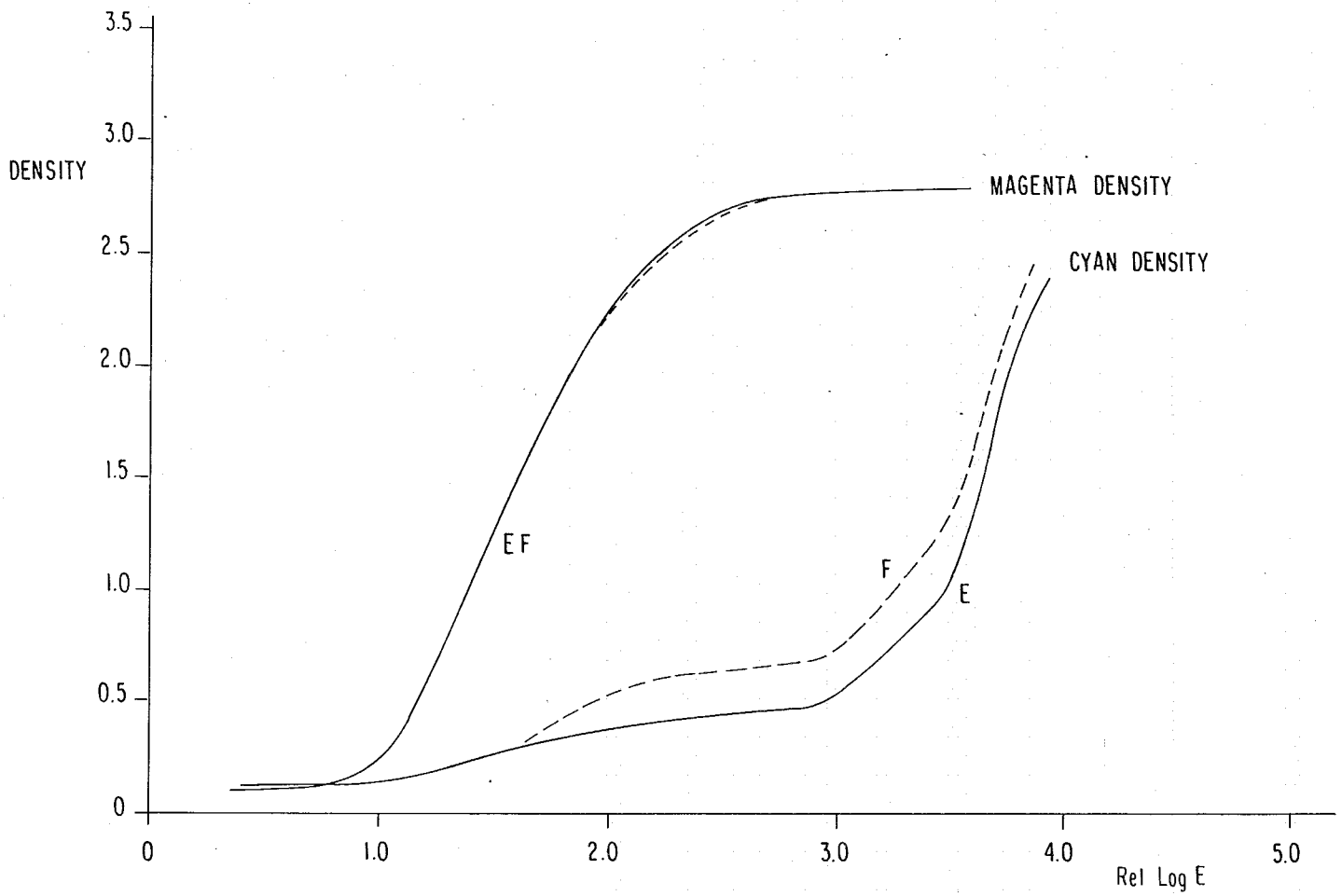
FIG. 2 is a graph showing other characteristic curves of magenta density and cyan density.

Each of Samples E and F thus prepared was exposed to green light through a continuous wedge, processed as in Example 1, and the densities were measured. Thus, the results shown in FIG. 2 were obtained.

From the results, it can be seen that the magenta density was almost the same in Samples E and F, in the cyan density, the results differed between Samples E and F and the cyan density was greatly increased in Sample F at a magenta density of higher than 1.5.

By using a color negative film of the type as was used in Example 1, prints of Samples E and F were prepared. The results were as follows.

Sample E: Saturation was very high, the color reproduction of a red cloth was particularly clear, but the shade of crease, etc., was difficult to distinguish.

Sample F: The shade of crease was seen, with clear color reproduction of the red cloth as compared to the case of Sample F.

Thus, it could be seen that in Sample F, details were well reproduced, without reducing the clear color reproduction.

EXAMPLE 3

Sample G was prepared by following the same procedure as in the case of preparing Sample E in Example 2, except that Layer 2 was omitted.

Figure 3:
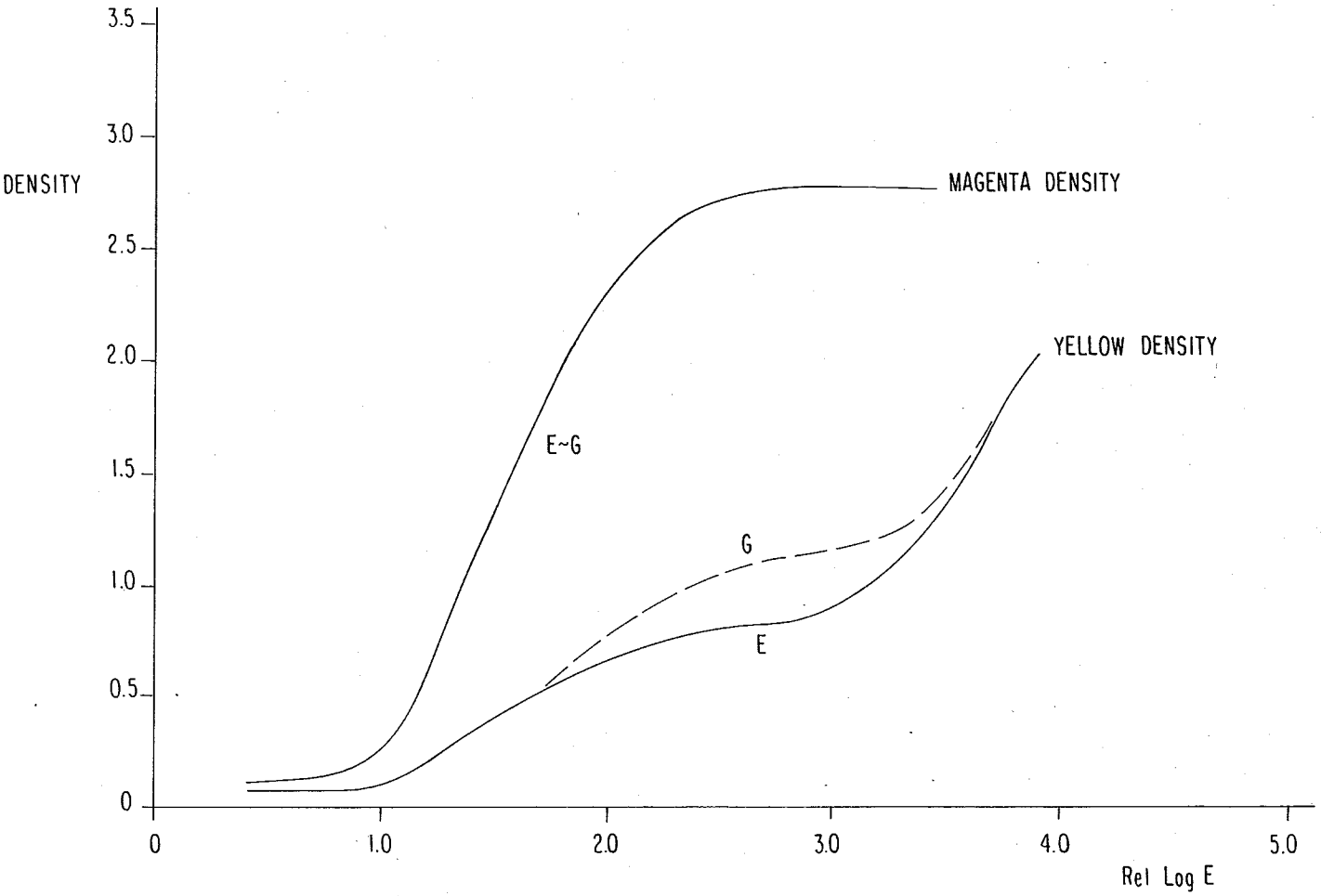
FIG. 3 is a graph showing characteristic curves of magenta density and yellow density.

Each of Sample E prepared in Example 2 and Sample G prepared as described above was exposed to green light through a continuous wedge, processed as in Example 1, and the densities were measured. Thus, the results shown in FIG. 3 were obtained.

From the results, it can be seen that the magenta density was almost the same in Samples E and F, but the yellow density measurement results were different in Samples E and G and in Sample G, the yellow density was increased at the magenta density of higher than 1.7.

An object including a dress having a delicate shade of blue instead of red was photographed using a color negative film providing a large interlayer effect to the blue-sensitive layer thereof and the print thereof was prepared on each sample. The results were as follows.

Sample E: Saturation was high and reproduction of the blue cloth was clear, but the shade thereof was difficult to distinguish.

Sample G: Magenta entered the image of the yellow object to reduce saturation, but provided the shade, and the shade was reproduced about a blue cloth.

EXAMPLE 4

A color photographic light-sensitive material was prepared by coating Layer 1 through Layer 11 shown below on a paper support having a polyethylene layer laminated on both surfaces. In the support, the polyethylene layer on the emulsion layer side contained $TiO_2$, etc., as white pigments and ultramarine blue, etc., as blue dyes.

Layer 1: Antihalation layer:

A layer containing 100 mg/m$^2$ of black colloid silver and 200 mg/m$^2$ of gelatin.

Layer 2: Low-speed red-sensitive emulsion layer:

A layer containing 150 mg/m$^2$ (as silver) of a silver iodobromide (3.5 mole% silver iodide, mean grain size 0.7 μm) spectrally sensitized by red-sensitizing dyes (*24 and *25), 300 mg/m$^2$ of a cyan coupler*26, 150 mg/m$^2$ of an anti-fading agent*27, 60 mg/m$^2$ of a coupler solvents*5 *and* *28, and 1000 mg/m$^2$ of gelatin.

Solvent*5 was described in Example 1.

Layer 3: High-speed red-sensitive emulsion layer:

A layer containing 100 mg/m$^2$ (as silver) of silver iodobromide emulsion (8.0 mole% silver iodide, mean grain size 0.7 μm) spectrally sensitizing by red-sensitizing dyes (*24 and *25), 100 mg/m$^2$ of a cyan coupler*26B, 50 mg/m$^2$ of an anti-fading agent*27, 20 mg/m$^2$ of coupler solvents*5 *and* *28 (*5 as in Example 1), and 500 mg/m$^2$ of gelatin.

Layer 4: Interlayer:

A layer containing 20 mg/m$^2$ of yellow colloid silver, 80 mg/m$^2$ of a color mixing preventing agent*16, 160 mg/m$^2$ of a color mixing preventing agent solvent*17, 400 mg/m$^2$ of a polymer latex*23, and 1000 mg/m$^2$ of gelatin.

Layer 5: Low-speed green-sensitive emulsion layer:

A layer containing 200 mg/m$^2$ (as silver) of a silver iodobromide emulsion (25 mole% silver iodide, mean grain size 0.4 μm) spectrally sensitized by a green-sensitizing dye*18, 150 mg/m$^2$ of a magenta coupler*19, 50 mg/m$^2$ of an anti-fading agent A*20, 50 mg/m$^2$ of an anti-fading agent B*21, 20 mg/m$^2$ of an anti-fading agent C*22, 150 mg/m$^2$ of a coupler solvent*12, and 700 mg/m$^2$ of gelatin.

Layer 6: High-speed green-sensitive emulsion layer:

A layer containing 200 mg/m$^2$ (as silver) of a silver iodobromide emulsion (3.5 mole% silver iodide, mean grain size 0.9 ηm) spectrally sensitized by a green-sensitizing dye*18, 150 mg/m$^2$ of a magenta coupler*19, 50 mg/m$^2$ of an anti-fading agent A*20, 50 mg/m$^2$ of an anti-fading agent B*21, 20 mg/m$^2$ of an anti-fading agent C*22, 150 mg/m$^2$ of a coupler solvent*12, and 700 mg/m$^2$ of gelatin.

Layer 7: Yellow filter layer:

A layer containing 200 mg/m$^2$ of yellow colloid silver, 60 mg/m$^2$ of a color mixing preventing agent*16, 240 mg/m$^2$ of a color mixing preventing agent solvent*17, and 1000 mg/m$^2$ of gelatin.

Layer 8: Low-speed blue-sensitive emulsion layer:

A layer containing 150 mg/m$^2$ (as silver) of a silver iodobromide emulsion (2.5 mole% silver iodide, mean grain size 0.5 μm) spectrally sensitizing by a blue-sensitizing dye*14, 200 mg/m$^2$ of a yellow coupler*15 , 50 mg/m$^2$ of a coupler solvent*12, and 500 mg/m$^2$ of gelatin.

Layer 9: High-speed blue-sensitive emulsion layer:

A layer containing 200 mg/m$^2$ (as silver) of a silver iodobromide emulsion (2.5 mole% silver iodide, mean grain size 1.0 μm) spectrally sensitized by a blue-sensitizing dye*14, 400 mg/m$^2$ of a yellow coupler*15, 100 mg/m$^2$ of a coupler solvent*12, and 1000 mg/m$^2$ of gelatin.

Layer 10: Ultraviolet absorption layer:

A layer containing 1000 mg/m$^2$ of a ultraviolet absorbent*11, 300 mg/m$^2$ of a ultraviolet absorbent solvent*12, a color mixing preventing agent*13, and 1500 mg/m$^2$ of gelatin.

Layer 11: Protective layer:

A layer containing 1000 mg/m$^2$ of gelatin.

The compounds used above were as follows.

(*11): 5-Chloro-2-(2-hydroxy-3-t-butyl-5-t-oxtyl)-phenylbenzotriazole (*12): Phosphoric acid trinonyl ester (*13): 2,5-Di-sec-octylhydroquinone (*14): Triethylammonium-3-[2-(3-benzylrhodanin-5-iridene)-3-benzoxazolinyl]propane sulfonate (*15): α-Pivaloyl-α-[(2,4-dioxo-1-benzyl-5-ethoxyhydantoin-3-yl)-2-chloro-5-(α-2,4-di-t-amylphenoxy)butanamido acetanilide (*16): 2,5-Di-t-octylhydroquinone (*17): Phosphoric acid o-cresyl ester (*18): 5,5'-Diphenyl-9-ethyl-3,3'-disulfopropyloxacarbocyanine sodium salt (*19): 1-(2,4,6-Trichlorophenyl)-3-(2-chloro-5-tetradecanamido)anilino-2-pyrazolino-5-one (*20): 3,3,3',3'-Tetramethyl-5,6,5',6'-tetrapropoxy-1,1'-bisspyroindane (*21): Di-(2-hydroxy-3-t-butyl-5-methylphenyl)methane (*22): 2,5-Di-t-hexylhydroquinone (*23): Polyethyl acrylate (*24): Triethylammonium-3-[2-{2-[3-(3-sulfopropyl)-naphtho-(1,2-d)thiazolin-2-iridenemethyl]-1-butenyl}-3-naphtho(1,2-d)thiazolino]propan sulfonate (*25): 5,5'-Dichloro-3,3'-di(3-sulfobutyl)-9-ethylthiacarbonylcyanine sodium salt (*26): 2-[α-(2,4-Di-t-amylphenoxy)butanamido]-4,6-dichloro-5-methylphenol (*27): 2-(2-Hydroxy-3-sec-butyl-5-t-butylphenyl)benzotriazole (*28): Dioctylphthalate The sample thus prepared was employed as Sample E as a comparison sample.

By following the same procedure as above except that Layer 6 of Sample H was replaced with the following 3 layers, Sample I was prepared.

That is, Layer 6-(3) shown below was disposed adjacent to Layer 7, Layer 6-(1) adjacent to Layer 6, and Layer 6-(2) between Layer 6-(3) and Layer 6-(1).

Layer 6-(1):

A layer containing 120 mg/m$^2$ (as silver) of a silver iodobromide emulsion (3.5 mole% silver iodide, mean grain size 0.75 μm) spectrally sensitized by the green-sensitizing dye*18, 90 mg/m$^2$ of the magenta coupler*19, 30 mg/m$^2$ of the anti-fading agent A*20, 30 mg/m$^2$ of the anti-fading agent B*21, 12 mg/m$^2$ of the anti-fading agent C*22, 90 mg/m$^2$ of the coupler solvent*12, and 420 mg/m$^2$ of gelatin.

Layer 6-(2):

A layer containing 80 mg/m$^2$ of the color mixing preventing agent*16 and 420 mg/m$^2$ of gelatin.

Layer 6-(3):

A layer containing 100 mg/m$^2$ (as silver) of a silver iodobromide emulsion (3.5 mole% silver iodide, mean grain size 0.95 μm) spectrally sensitized by the green sensitizing dye*18, 60 mg/m$^2$ of the magenta coupler*19, 15 mg/m$^2$ of the cyan coupler*26, 20 mg/m$^2$ of the anti-fading agent A*20, 20 mg/m$^2$ of the anti-fading agent B*21, 2 mg/m$^2$ of the anti-fading agent C*22, 60 mg/m$^2$ of the coupler solvent*12, and 380 mg/m$^2$ of gelatin.

Each of Samples H and I was exposed to red light through a continuous wedge, then uniformly exposed through a cyan interference filter, and processed as follows.

| Processing Step: | | |
|---|---|---|
| First development (white and black development) | 38° C. | 75 sec. |
| Washing with water | 38° C. | 90 sec. |
| Reversal exposure | 100 lux | |
| Color development | 38° C. | 135 sec. |
| Washing with water | 38° C. | 45 sec. |
| Blix | 38° C. | 120 sec. |
| Washing with water | 38° C. | 135 sec. |
| Dry | | |

The compositions of the processing solutions used in the above processing step were as follows:

| | |
|---|---|
| First Developer: | |
| Nitrilo-N,N,N—trimethylenephosphonic acid 6-sodium salt | 3.0 g |
| Anhydrous potassium sulfite | 20.0 g |
| Sodium thiocyanate | 1.2 g |
| 1-Phenyl-4-methyl-4-hydroxymethyl-3-pyrazolidone | 2.0 g |
| Anhydrous sodium carbonate | 3.0 g |
| Hydroquinone monosulfonate potassium salt | 30.0 g |
| Potassium bromide | 2.5 g |
| Potassium iodide (0.1% aq. soln.) | 2 ml |
| Water to make | 1000 ml |
| pH adjusted to 9.7 | |
| Color Developer: | |
| Benzyl alcohol | 15.0 ml |
| Ethylene glycol | 12.0 ml |
| Nitrilo-N,N,N—trimethylene phosphonic acid 6-sodium salt | 3.0 g |
| Sodium carbonate | 26.0 g |
| Sodium sulfite | 2.0 g |
| 1,2-Di(2'-hydroxyethyl)mercatoethane | 0.6 g |
| Hydroxylamine sulfate | 3.0 g |
| 3-Methyl-4-amino-N—ethyl-β-methane-sulfonamidoethylaniline sulfate | 5.0 g |
| Sodium bromide | 0.5 g |

-continued

| | |
|---|---|
| Potassium iodide (0.1% aq. soln.) | 0.5 ml |
| Water to make | 1000 ml |
| pH adjusted to 10.5 | |
| Blix Solution: | |
| Ammonium ethylenediamine-N,N,N',N'—tetraacetato ferrate (III) dihydrate | 8.0 g |
| Sodium metahydrogensulfite | 15.0 g |
| Ammonium thiosulfate (58% aq. soln.) | 126.6 ml |
| 2-Mercapto-1,3,5-triazole | 0.20 g |
| Water to make | 1000 ml |
| pH adjusted to 6.5 | |

Then, the densities of the images thus obtained were measured. The results were as follows.

| | Sample H | Sample I |
|---|---|---|
| Cyan density in magenta density of 1.0 | 0.26 | 0.26 |
| Cyan density in magenta density of 1.5 | 0.32 | 0.32 |
| Cyan density in magenta density of 2.0 | 0.38 | 0.47 |

In this example, color gradations of white to red were reproduced by coloring of magenta and yellow, and it is clear that in Sample I, the reproduction of shade is better than in Sample H, by the existence of a cyan component in a red portion of high purity in Sample I as in the case of Example 2.

While the invention has been described in detail and with reference to specific embodiments thereof, it will be apparent to one skilled in the art that various changes and modifications can be made therein without departing from the spirit and scope thereof.

What is claimed is:

1. A multilayer silver halide color photographic material comprising a reflective support having thereon at least two light-sensitive silver halide emulsion layers (A) and (B), each of the emulsion layers (A) and (B) having a different spectral sensitivity and each of the emulsion layers (A) and (B) containing at lest one dye-forming agent which forms an imaging dye of a different hue in the emulsion layer (A) and (B) on processing; wherein when at least one of said emulsion layers (A) and (B) yields a dye image by processing after image wise exposure, at least one another dye-forming agent (C), on the processing, yields a dye of a hue substantially different from at least one of the hue of the layers (A) and (B) in which the dye formed by the dye-forming agent (C) is present in the region where the image density of the at least one imaging dye is over a definite density value in the range of 1.3 to 2.0, whereby said at least one dye-forming agent (C) provides gradation to the region over the definite density value of from 1.3 to 2.0, the different hue due to the dye-forming agent (C) not being added to a density region in which the density is not more than the definite value, wherein any dye-forming agent is not a development inhibitor releasing coupler and not a colored coupler.

2. A multilayer silver halide color photographic material as in claim 1, comprising a support having thereon a cyan-coloring coupler-containing red-sensitive silver halide emulsion layer, a magenta-coloring coupler-containing green-sensitive silver halide emulsion, and a yellow-coloring coupler-containing blue-sensitive silver halide emulsion layer, wherein a cyan gradation is added to a specific image region in which the density of a magenta image is over a definite density value of from 1.3 to 2.0.

3. A multilayer silver halide color photographic material as in claim 1, wherein any dye-forming agent is a coupler providing a colored dye.

4. A multilayer silver halide color photographic material as in claim 1, wherein the density region in which said dye of a hue substantially not contributing to the formation of the hue of a specific image of region is provided in a density region of from 1.4 to 1.6.

5. A multilayer silver halide color photographic material as in claim 1, wherein any dye-forming agent is a coupler releasing a development accelerator.

6. A multilayer silver halide color photographic material as in claim 2, wherein the cyan gradation is added to a specific region wherein the density of a magenta image is provided in a density region of from 1.4 to 1.6.

7. A multilayer silver halide color photographic material as in claim 1, wherein the dye-forming agents are photographic couplers capable of forming colored dyes by causing the oxidative coupling with aromatic primary amine developing agent.

8. A multilayer silver halide color photographic material as in claim 1, wherein any dye-forming agent is a redox dye releasing compound.

9. A multilayer silver halide color photographic material as in claim 1, comprising a cyan-coloring coupler-containing red-sensitive silver halide emulsion layer, a magenta-coloring coupler-containing green-sensitive silver halide emulsion layer, and a yellow-coloring coupler-containing blue-sensitive silver halide emulsion layer.

10. A multilayer silver halide color photographic material as in claim 1, comprising a cyan dye releasing red-sensitive silver halide emulsion layer, a magenta dye releasing green-sensitive silver halide emulsion layer, and a yellow dye releasing blue-sensitive silver halide emulsion layer.

11. A multilayer silver halide color photographic material as in claim 1, wherein a cyan gradation is added to a specific image region in which the density of a magenta image is over a definite density value of from 1.3 to 2.0.

12. A multilayer silver halide color photographic material as in claim 1, wherein a cyan gradation is added to a specific hue region in which the density of a magenta image is over a definite density value of from 1.4 to 1.6.

13. A multilayer silver halide color photographic material as in claim 1, wherein the photographic material is a color photographic paper, a color photographic positive film, and a reversal color photographic paper.

14. A multilayer of silver halide color photographic material as in claim 1, wherein the dye-forming agent (C) is the same dye-forming agent as in the layer (A) or (B).

15. A multilayer silver halide color photographic material as in claim 1, wherein the support is a paper which is laminated by an α-olefin polymer comprising a barayta layer coated paper or a white pigment.

16. A multilayer silver halide color photographic material as in claim 1, wherein the cyan gradation is added by which the cyan-coloring red-sensitive silver halide emulsion layer is additionally green sensitized.

17. A multilayer silver halide color photographic material as in claim 16, wherein a cyan gradation is added to a specific image region in which the density of a magenta image is over a definite density value of from 1.3 to 2.0.

18. A multilayer silver halide color photographic material as in claim 16, wherein a cyan gradation is added to a specific image region in which the density of a magenta image is over a definite density value of from 1.4 to 1.6.

19. A multilayer silver halide color photographic material as in claim 11, comprising a reflective support having thereon at least one cyan-coloring red-sensitive silver halide emulsion layer, at least two different sensitive magenta-coloring green-sensitive silver halide emulsion layer, and at least one yellow-coloring blue-sensitive silver halide emulsion layer, wherein a magenta-coloring green-sensitive silver halide emulsion layer which is not the maximum density is magenta-coloring and cyan-coloring.

20. A multilayer silver halide color photographic material as in claim 11, comprising a support having thereon a cyan-coloring red-sensitive silver halide emulsion layer, a magenta-coloring green-sensitive silver halide emulsion layer, and a yellow-coloring blue-sensitive silver halide emulsion layer, wherein a cyan-coloring red-sensitive silver halide emulsion layer is disposed adjacent to a magenta-coloring green-sensitive silver halide emulsion layer, and the content of a coloring mixing preventing layer between the above two layers is present is such that the color mixing preventing layer causes the cyan mixing when the density of a magenta image is over the definite density value of from 1.2 to 2.5.

21. A multilayer silver halide color photographic material as in claim 1, wherein at least one emulsion layer of a cyan-coloring red-sensitive emulsion layer, a magenta-coloring green-sensitive emulsion layer and a yellow-coloring blue-sensitive emulsion layer is spectrally sensitized for a wavelength region corresponding to a part or the whole of the complementary colors of the spectral sensitization distribution thereof and the sensitivity of said emulsion layer is adjusted to a value properly lower than those of other light-sensitive emulsion layer(s) which are fundamentally sensitive to an exposure light corresponding to the complementary color.

22. A multilayer silver halide color photographic material as in claim 21, wherein the cyan-coloring red-sensitive emulsion layer is also green- and/or blue-sensitized.

23. A multilayer silver halide color photographic material as in claim 1, wherein at least one layer of a red-sensitive emulsion layer, a green-sensitive emulsion layer and a blue-sensitive emulsion layer is constructed of at least one high-speed emulsion layer and at least one low-speed emulsion layer and dye-forming agents are incorporated in these emulsion layers in such a manner that in the high-speed emulsion layer, the complementary color to the color of sensitive light for the high-speed emulsion layer is formed and in the low-speed emulsion layer, the complementary color to the color of the sensitive light for the low-speed emulsion layer and colors other than the complementary color are simultaneously formed.

24. A multilayer silver halide color photographic material as in claim 23, wherein the green-sensitive emulsion layer and/or the blue-sensitive emulsion layer is (are) constructed of at least one high-speed emulsion layer and at least one low-speed emulsion layer and a cyan-forming agent is incorporated with a magenta-forming agent or a yellow-forming agent in the low-speed emulsion layer.

25. A multilayer silver halide color photographic material as in claim 1, wherein at least one of a red-sensitive emulsion layer, a green-sensitive emulsion layer and a blue-sensitive emulsion layer is constructed of a high-speed emulsion layer and a low-speed emulsion layer and the low-speed emulsion layer is disposed adjacent to another color-sensitive emulsion layer or an interlayer having only a limited color mixing-preventing faculty is formed between the low-speed emulsion layer and another layer to which the oxidation product of color developing agent diffuses.

26. A multilayer silver halide color photographic material as in claim 25, wherein the interlayer is disposed adjacent to the green-sensitive emulsion layer and the red-sensitive emulsion layer, or to the blue-sensitive emulsion layer and the red-sensitive emulsion layer.

27. A multilayer silver halide color photographic material as in claim 1, wherein at least one layer of a red-sensitive emulsion layer, a green-sensitive emulsion layer and a blue-sensitive emulsion layer is constructed of a high-speed emulsion layer and a low-speed emulsion layer and a diffusible development accelerator-releasing coupler is incorporated in the low-speed emulsion layer and the development accelerator is diffused over a color mixing-preventing layer.

28. A multilayer silver halide color photographic material as in claim 27, wherein the diffusible development accelerator-releasing coupler is incorporated in the green-sensitive emulsion layer and/or the blue-sensitive emulsion layer so as to diffuse the released development accelerator into the red-sensitive emulsion layer.

29. A multilayer halide color photographic material as in claim 1, wherein the said other dye-forming agent forms, by said processing, a dye substantially not contributing to the formation of the density of the said dye images at said density region over a definite density value of from 1.3 to 2.0.

* * * * *